US008174378B2

(12) United States Patent
Richman et al.

(10) Patent No.: US 8,174,378 B2
(45) Date of Patent: May 8, 2012

(54) HUMAN GUARD ENHANCING MULTIPLE SITE SECURITY SYSTEM

(75) Inventors: Lawrence Richman, La Mesa, CA (US); Anca Vacaru, San Diego, CA (US); Olga A. Zatusevschi, San Diego, CA (US)

(73) Assignee: Richman Technology Corporation, San Diego, CA (US)

( * ) Notice: Subject to any disclaimer, the term of this patent is extended or adjusted under 35 U.S.C. 154(b) by 969 days.

(21) Appl. No.: 12/067,271

(22) PCT Filed: Mar. 18, 2005

(86) PCT No.: PCT/US2005/009408

§ 371 (c)(1),
(2), (4) Date: Mar. 18, 2008

(87) PCT Pub. No.: WO2006/101490

PCT Pub. Date: Sep. 28, 2006

(65) Prior Publication Data

US 2010/0238019 A1 Sep. 23, 2010

(51) Int. Cl.
*G08B 19/00* (2006.01)
*G08B 1/00* (2006.01)
*G08B 29/00* (2006.01)

(52) U.S. Cl. ... 340/521; 340/506; 340/531; 340/539.16; 340/522; 348/143; 700/83

(58) Field of Classification Search ..... 340/521
See application file for complete search history.

(56) References Cited

U.S. PATENT DOCUMENTS

| | | | | |
|---|---|---|---|---|
| 6,400,265 | B1 * | 6/2002 | Saylor et al. | 340/531 |
| 6,505,086 | B1 * | 1/2003 | Dodd et al. | 700/65 |
| 6,686,838 | B1 * | 2/2004 | Rezvani et al. | 340/506 |
| 2003/0206100 | A1 * | 11/2003 | Richman et al. | 340/506 |

* cited by examiner

*Primary Examiner* — Donnie Crosland
(74) *Attorney, Agent, or Firm* — Foley & Lardner LLP

(57) ABSTRACT

Provided is a human guard enhancing multiple site security system comprising one or more human guards, peripheral equipment positioned at one or more sites, said peripheral equipment comprising one or more of a plurality of sensors, video cameras, positioning systems, and mobile communication and data processing equipment, said peripheral equipment being further capable of collecting and transmitting event-related and environmental data, one or more checkpoint systems capable of receiving, processing into a standardized protocol, and further relaying the data received from said peripheral equipment, and of providing said one or more guards with information based on the data, and one or more stations capable of logging, processing, and reporting the data relayed from said one or more checkpoint systems to provide a security system status and to facilitate human supervision, situation analysis, decision making, and intervention. The system includes a computer implemented communications protocol, which is an XML based communications protocol for real time security alert monitoring purposes. The XML based communications protocol consists of numerous modules which receive and convert data messages from varying security devices and sensors, standardize, translate and send converted messages, and encrypt and decrypt said data messages.

26 Claims, 14 Drawing Sheets

HUMAN GUARD ENHANCING MULTIPLE SITE SECURITY SYSTEM

TECHNICAL FIELD

The present invention relates to a guard enhancing multiple site integrated security system and method of making same. More particularly, the present invention relates to a human security guard oriented system of security service, training and multiple site monitoring, which facilitates communications between real time security hardware and a real time security alert monitoring thereby providing human security guards with the latest technology to make them more intelligent and responsive within a complex interactive environment.

BACKGROUND ART

In addition to traditional threats to security such as burglary, vandalism and arson, today's complex national and international political conflicts are putting increased pressure on facilities and organizations of all kinds to provide effective security systems for the safety and protection of personnel, property and surroundings.

Devices and systems for the provision of safety and security of persons and property are well known. Examples of different types and kinds of security systems for protection and surveillance methods of building structures and surrounding areas are disclosed in numerous worldwide patents.

In general, the structure and function of most security systems involves electronic surveillance equipment monitored at a centralized location. Current development of security systems attempts to do away with human-oriented services and replace the human security guard with high technology solutions to security problems. Only a limited number of currently developed security systems utilize a combination of guards in close conjunction with the electronic equipment. Most of the time, these systems involve one guard who monitors a video feed or alarm panel for intrusion or other related alerts. These security systems are commonly built, installed and implemented without any regard for the particular facilities of other systems, for example, the facilities of built-in environmental and climate control, the tracking of people and assets within the building or complex, and fire/smoke detection as well as transport systems such as elevators, etc.

Therefore, it would be highly desirable to have a new and improved security system which not only enhances the human security guard services, but also integrates facilities management, and allows for real time identification, global positioning satellite (GPS) tracking, radio frequency identification (RFID) tracking, Wi-Fi and other tracking methods for people as well as assets such as computers, and other valuable instrumentation, all in a readily scalable configuration utilizing off the shelf electronic security and communications components.

An electronic surveillance system for remote guarding of an area using an operator station including a signal receiver with television display, radiant energy selection control, and energy level controller is known in the prior art. Such a device remotely controls and directs an apparatus "weapon" for integration with traditionally secured facilities, remote detection devices, closed circuit TV, and a remotely-located, manned control station. While such a computerized system is helpful in detection of unauthorized personnel in a given area and does seek to incorporate pre-existing security devices, there is no provision which would allow for the irreplaceable and highly effective presence of human security guards, guards that are further enhanced by electronic wireless communications and monitoring.

Additionally, the entire system depends upon the installation and presence of numerous hard wired security devices in a given area and is not readily scalable to incorporate larger areas in the surveillance area in a short period of time without extensive outlay of effort and installation of new equipment. The acoustic energy "weapon" used as a deterrent to intruders is not confined to any given space and might pose a threat to anyone, including authorized individuals, within hearing distance.

Therefore, it would be highly desirable to have a new and improved enhanced security guard system which would allow for computerized and wireless communications and monitoring of human security guards and their activities with a centralized location, in addition to conventional security devices and which would be scalable with minimal time and material expenditure, and which would provide for human guards to act as a more rapid and effective deterrent to intruders.

The conventional exit guard system addresses the requirements of providing areas with detection of movement of a subject along an exit path in an unauthorized direction. This system further provides for a human monitor at a centralized location with added supervision of the deactivation of the security alarm system only by authorized personnel.

However, within this system there is no human security guard on site actively patrolling the area. This electronically augmented human presence is irreplaceable as a deterrent to potential intruders as well as providing for flexibility in terms of monitoring and responding to a variety of situations that might arise.

Therefore, it would be highly desirable to have a new and improved, technologically augmented human presence automatically reporting to a centralized location, or a remote monitoring station through communications over a global computer network, cellular telephone network, or via satellite link, which could then monitor and record guard activities as well as utilize pre-existing event detection technology, such as motion, video and perimeter control devices to alert those guards of real time events taking place on their shift.

Many patents describe relatively sophisticated security systems utilizing video images obtained from a plurality of cameras relayed to a site control unit equipped with an automated image processor. The images are then relayed to a security system operator who then analyzes the images and informs authorities of an intrusion.

While these systems utilize advanced technological features to distinguish between actual intrusions and false alarms (friend or foe), the absence of a human guard which would serve to discourage intrusions is notably absent. Moreover, the presence of human guards makes those that are present within the facility feel protected and well taken care of, and these individuals will often speak to the security guards or become familiar with them to avoid any misunderstanding as to their access authorization or the like.

Additionally, the highly automated image processor and related complex software used to differentiate between actual foe intrusions and friendly false alarms is inherently limited in its capability to observe, compare and react to the myriad of potential one time or entirely novel situations which might occur. This type of security monitoring can only be accomplished with highly trained, well equipped, and competently supervised human security guards on duty in numbers corresponding to the amount of space or activity required for optimal security from outside threats.

Therefore, it would be highly desirable to have a new and improved system for the technological augmentation of human guards who are irreplaceable in terms of providing a deterrent to intrusion and who are capable of observing, assessing and responding to novel and unusual situations and whose actions would automatically be reported to a centralized headquarters with integrated automated daily events and incident real time reporting.

Finally, there are patented inventions which provide for an apparatus for monitoring subjects having a location determining device which provides the location of the subject to a processor. The processor then stores and retrieves data generated or received by the processor. The primary means by which the subject is tracked is by usage of a GPS. Comparison of the parameters of given geographical boundaries to the data from the location determining device may determine if the subject has deviated from those parameters. The claimed invention mandates detection of at least one physiological parameter of the subject in order to compare existing subject data previously stored.

These imaginative inventions do provide for tracking and determination of the general area in which a subject is to be found and a means by which to compare the location with a pre-determined geographic location. Unfortunately, while the location and tracking device may show a general area in which the subject is located, there is no way of determining the exact location of the subject at any given point in time.

In addition, this system again depends upon a complex processor which must be programmed with any number of parameters. The system may fail to operate properly or may not operate at all if incorporated into a pre-existing security system, especially one having less complex processors available on site.

Therefore, it would be highly desirable to have a new and improved system for technological augmentation of human guards automatically reporting exact location and time to a centralized headquarters with daily events and incident reporting automation which could give exact locations and time records of movement of the guards which would readily incorporate pre-existing hardware and software. Moreover, it would be highly desirable to enable said guards to be alerted in real time when security threatening events or environmental events occur including the automated translations of these real time alerts into local dialects and local languages.

DISCLOSURE OF INVENTION

It is therefore the principal advantage of the instant invention to provide a multiple site, integrated security system which incorporates and enhances the performance of human guards within said security system. The invaluable human presence acts as a deterrent and provides the irreplaceable human capability to observe, assess, coordinate, and react instantaneously to unusual and immediate circumstances.

It is another advantage of the instant invention to provide the human guards with the latest technology, in the form of wearable and hand held computers or other data processors capable of wireless communications, in order to make the guards more intelligent and responsible to the guarded facilities complex interactive environment.

Another advantage of the instant invention is to provide a system which would be flexible in incorporating new technology and pre-existing hardware equipment thus providing a high level of integration with off the shelf security devices now existing or not yet conceived.

It is a further advantage of the instant invention to provide a system of security which is able to be custom configured and scaled up or down, by being individually tailored to site conditions such as site component configurations, checkpoint locations, building type material, building transportation systems, facilities environmental control systems, such as climate control, fire and smoke detection, and other varied parameters.

Yet another advantage of the present invention is to provide a system which would automatically monitor and control certain movable and fixed site conditions such as people and vehicles at checkpoints, safety systems, access control systems, position sensors, transportation control systems, power supply systems, water and hydraulic control systems, warning systems, lighting systems, communications systems and miscellaneous site-specific systems such as greenhouse temperature controls.

Yet a further advantage of the invention is to enable training of human guards including drills, system operating instructions, and interactive testing of guard utilization of all system components, including software, hardware and communications.

Still another advantage of the instant invention is to provide a system for security which monitors the identification and authorization of personnel inside secured areas through use of a two points access subsystem composed of a fixed device installed at a checkpoint and a mobile device (wearable or hand held) carried by authorized personnel which could be configured to integrate pre-existing security systems without modification of the core program.

Another advantage of the instant invention is to provide a guard activity and real time reporting support system which includes a scheduled building and real time guard tour tracking system.

Yet another advantage of the instant invention is to provide a system whereby bi-directional data and command transmission may occur between a base station (computer or server configuration) and any designated person or group of persons, which enables assistance deployment and transmits the location of the person, group of persons, security guards and/or guard vehicles.

A further advantage of the instant invention is to provide a system which records real-time object identification and tracking subsystems for indoor and outdoor areas.

Another advantage of the present invention is to provide a site video monitoring system which will be recorded, transmitted and displayed at a base station (computer or server configuration) with the option of video data processing, to recognize and alert of certain predetermined events, such as access verification, etc.

Still another advantage of the invention is to provide a system which may integrate pre-existing hardware into the system without requiring purchase of redundant hardware.

Yet another advantage of the invention is to provide a system whereby there is automation of communication between base station and headquarters and between base station and any other specified person or distribution point whether mobile or fixed.

It is also another advantage of the present invention to provide a system which would automate time sheets, payroll recap and other accounting operations.

It is another advantage of the present invention to provide a system which provides availability of site level information from a centralized headquarters, or remotely away from a centralized headquarters.

Still another advantage of the present invention is to provide a system which would provide access to historical information such as time sheets, event logs, and alert logs to designated personnel.

Yet another advantage of the present invention is to provide a means of communication via the Internet with a central console monitoring application.

Still another advantage of the present invention is to provide a system with failure-resistance and robustness against hardware denials and intentional attacks by providing data backup on both facilities site and at security headquarter levels.

It is yet another advantage of the present invention to provide a system capable of communicating with preexisting and/or pre-built system configurations to be installed at specific kinds of sites.

It is also another advantage of the present invention to provide a computer-implemented coordinated communications protocol and system, which would automate a real time alert system, direct security alerts, and translate those alerts into the local dialect or language.

It is another advantage of the present invention to provide a security system which would support several levels of software, users, data, applications and communications, and whereby security tasks are performed and verified by the guard during the guard tour and that information is recorded by the guard in a checkpoint data processing application, then that recorded information is passed to a base station (computer or server) processing application. The ability to provide central monitoring of guard tours is dependent upon novel wearable and hand held devices which are capable of wireless communications with the data processing checkpoint stations.

Briefly, the advantages of the present invention are realized by providing a human-oriented security guard system as the pivotal aspect of the security system, whereby said guards are greatly enhanced by implementation of varying security device and microprocessor technology. The technological aspect of the system is not specific to any devices or equipment currently on the market but would be site specific and would have the option of incorporating pre-existing technology in centralized monitoring of the site. A high level integration enables introduction of novel technology appearing on the market or pre-existing site specific technology into the security system. Supported features of the system include a guard tour control system, centralized coordinated communications and reporting with headquarters, schedule builder and time recap automation, daily events and incident automation, support of security protocol, optional web access to the base station application, synchronization with headquarters accounting database and centralized connection to existing client's equipment. The primary goal of the system configuration is to make guard tour tasks planned, controlled, monitored, recorded, expensed and paid in a highly efficient and effective manner.

Moreover, the advantages of the present invention are realized by providing a human guard enhancing multiple site security system comprising one or more human guards, peripheral equipment positioned at one or more sites, said peripheral equipment comprising one or more of a plurality of sensors, video cameras, positioning systems, and mobile communication and data processing equipment, said peripheral equipment being further capable of collecting and transmitting event-related and environmental data, one or more checkpoint systems capable of receiving, processing into a standardized protocol, and further relaying the data received from said peripheral equipment, and of providing said one or more guards with information based on the data, and one or more stations capable of logging, processing, and reporting the data relayed from said one or more checkpoint systems to provide a security system status and to facilitate human supervision, situation analysis, decision making, and intervention.

Additionally, a new and improved computer implemented communications protocol is provided, which is an XML based communications protocol for security monitoring purposes. This unique XML based communications protocol is implemented through numerous modules which receive and convert data messages from diverse security devices and sensors, standardize and send converted messages, and encrypt and decrypt said data messages to security personnel as necessary. With the set modules, the data messages are filtered and transmitted from checkpoint computers to base station computers, which analyze, report, and log environmental as well as security events within a subject site. Moreover, real time alerts may be translated into local dialects and languages as necessary. The resulting integrated security system provides better monitoring and response tools to the security guards, better trained security guards, who are more alert and responsive, and more closely supervised and easily scheduled guards, with enhanced financial monitoring, more accurately paid and cost analyzed security services, better archived and reported security related events, as well as better coordination with public agencies, enhanced safety, and readily upgraded and integrated with existing and future technologies. Real time alerts may be selectively directed to a number of other systems, including public safety agencies, government offices, school campuses, communities and globally.

Therefore, this new and improved multiple site, readily scalable security system is provided which combines human-based security personnel integrated with a diverse integrated array of fixed and movable electronic security enhancing components, and numerous modes of communications between said components, including hard wired and wireless applications. The security related components include event sensors, identification tracking for people and things, access control devices, security guard wearable computers and hand held computers as well as embedded data processing control and communications systems, with all sensors and sites capable of being monitored by a designated headquarters through checkpoint data processing components and base station components. The security system provides better trained security guards, who are more alert and responsive, and more closely supervised and easily scheduled, enhanced financial monitoring, more accurately paid and expensed security services, better archived and reported security related events, as well as being better coordinated with public agencies, enhanced safety, and readily upgraded with existing and future technologies.

The above-mentioned and other advantages and features of the present invention and the manner of attaining them will become apparent, and the invention itself will be best understood to those of skill in the art by reference to the disclosure herein in conjunction with the accompanying drawings.

BRIEF DESCRIPTION OF DRAWINGS

The accompanying drawings, which are incorporated in and form a part of this specification, illustrate embodiments of the invention, and together with the description, serve to explain the principles of this invention, wherein.

BEST MODE FOR CARRYING OUT THE INVENTION

Figure 1:
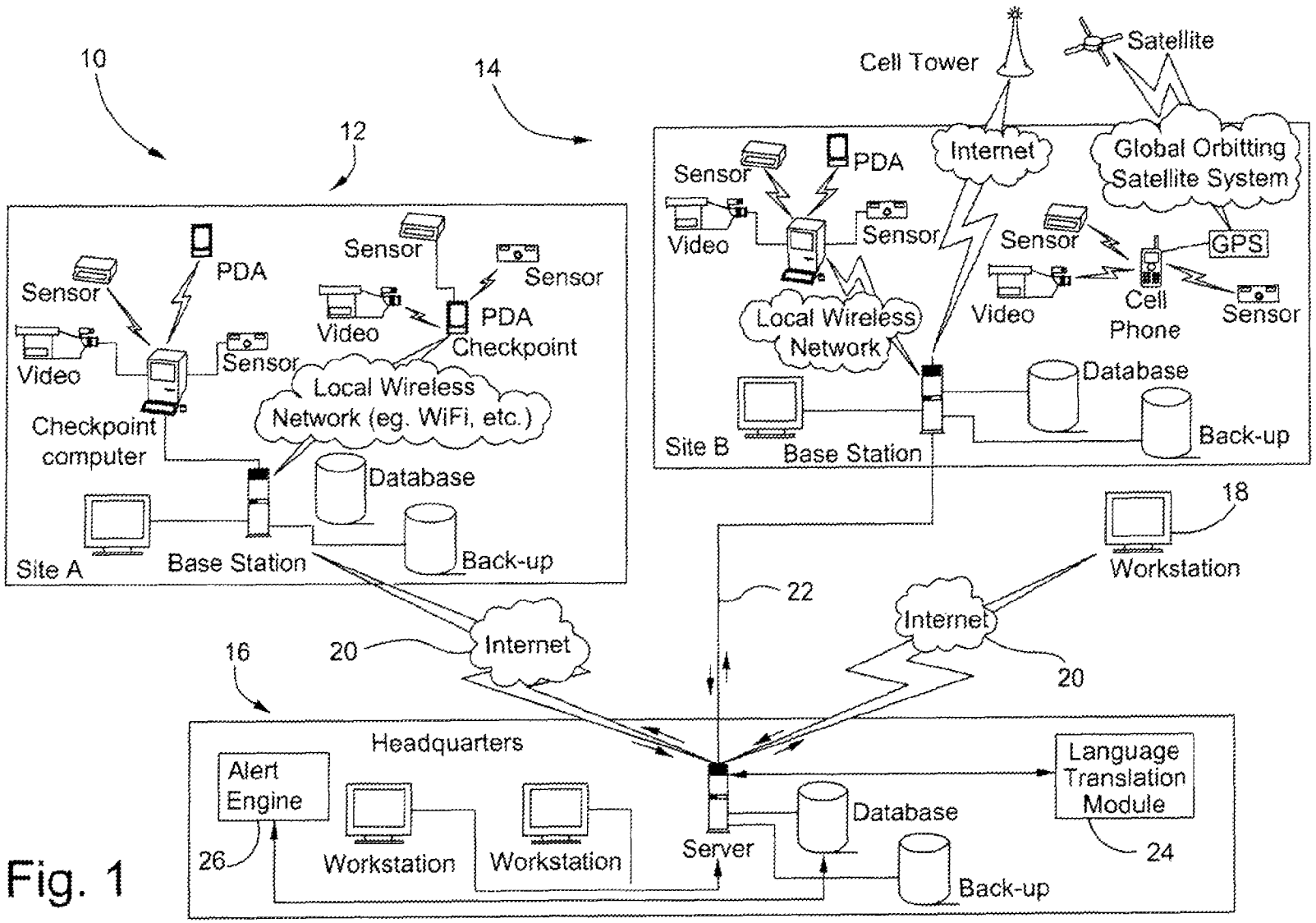
FIG. 1 is a representational diagram of a multiple site integrated security system constructed in accordance with the present invention.

Referring now to the drawings, and more particularly to FIG. 1 thereof, there is shown a new and improved multiple site integrated enhanced human oriented security system 10 capable of exchanging data among human guards, peripheral equipment monitoring the sites where security system 10 is activated, and stations where the data collected at the sites is analyzed and appropriate countermeasures are implemented. Specifically, the multiple site integrated security system 10 as represented by FIG. 1 and constructed in accordance with the present invention, uses direct communication, for example, hard wired bi-directional communication 22, and indirect communication, for example, use of a global computer network like the Internet 20, as methods of communication between a central headquarters 16 and one or more facilities sites 12 and 14. Direct communication is defined as a point-to-point connection containing hard wired and/or wireless components in which the sender and receiver are not separated by switching nodes. One example of this is the communication between a wireless transmitter and a wireless receiver. On the other hand, indirect communication can be defined herein as a connection containing hard wired and/or wireless components in which the sender and receiver are separated by switching nodes. This is best exemplified by a local area network (or LAN) and a global computer network, such as the Internet.

The new multiple site integrated security system 10 may be tailored to site specific needs or pre-existing hardware and equipment as represented by a Site A security subsystem 12 and a Site B security subsystem 14. The sites may be in communication with the integrated headquarters server subsystem 16 by means of direct communication 22 as exemplified by communication with the Site B security subsystem 14. This direct communication 22 between the sensors and the checkpoint data processing subsystems and between the checkpoint data processing subsystems and the base station CPUs may also be accomplished through the use of existing electrical power lines located at the guarded facility or site.

In the alternative, communication with the integrated headquarters server subsystem 16 may be accomplished via a global computer network, such as the Internet, as exemplified by communication between the integrated headquarters server subsystem 16 and the Site A security subsystem 12. Furthermore, it is contemplated that said communications be made via a global orbiting satellite system (such as the existing global positioning satellite or GPS system) or a similar high altitude or outer space vehicle sensing the data transmissions. Moreover, any energy transmission may be used by the security system, for example, including but not limited to shortwave, long wave, microwave, X-ray, gamma ray, radio frequencies, and cellular telephone frequencies.

Figure 2:
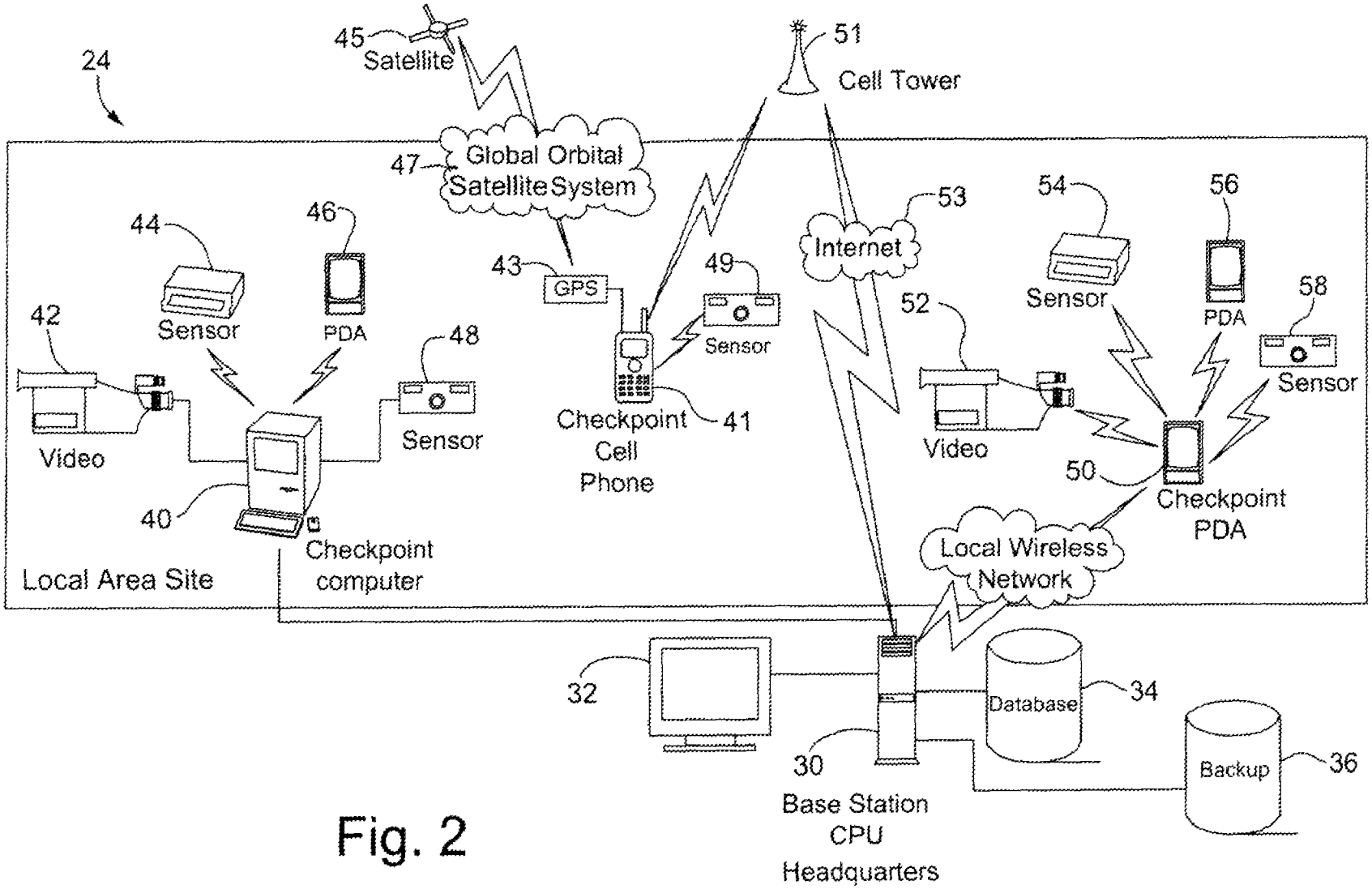
FIG. 2 is an enlarged detailed diagram of a communications scheme between multiple checkpoint data processors and a central base station computer, constructed in accordance with the present invention.

Turning now to FIG. 2, there is shown a more detailed view of one example of a possible local area site security subsystem configuration 24. The base station central processing unit (or CPU) 30 is in communication with checkpoint data processors or computers as exemplified by checkpoint computer 40 and a checkpoint personal digital assistant, or checkpoint PDA 50. The checkpoint data processing subsystems 40 and 50 are either installed within the local area site 24, or are mobile devices operating within the local area site 24, and are connected to all hardware devices providing security in this local area site 24. The checkpoint data processing subsystems 40 and 50 collect information from wireless sensors 44 and 54, and other peripheral equipment such as wireless personal digital assistants (or PDAs) 46 and 56, hard wired sensors 48 and 58 and hard wired video cameras 42 and wireless video camera 52. Hard wired sensors 48 and 58 may be pre-existing units, or in the alternative, may be off the shelf security equipment designed to be installed and operated as motion sensors, heat sensors, etc. Moreover, it is contemplated that the video transmission feeds may come from both hard wired video cameras such as 42 and or from wireless video cameras 52, as shown. In some instances, automated video monitoring may be employed at the checkpoint level, or in the alternative, at the base station level of the security systems architecture.

The checkpoint data processing subsystems 40 and 50 then process all of the information gathered from any peripheral equipment as exemplified by 42, 44, 46, 48, 52, 54, 56, and 58, and transmits the event sensor information to the base station computer or CPU 30.

In general, the peripheral equipment is capable of detecting events that are adverse to the security and safety of persons and things, more specifically, event-related data and environmental data, such as criminal acts, terrorist threats and acts, war acts, riots, civil unrest, political events, structural failures, power failures, electronic failures, adverse weather, fire hazards, seismic events, variations in light and temperature, and other hazardous conditions requiring situation assessment and countermeasures. Examples of peripheral equipment include sensors, video cameras, positioning systems, and mobile communication and data processing equipment, such as cellular telephones and PDAs.

Further, the multiple site integrated system 10 can be operated to provide the guards with real and simulated data suitable for an interactive training of the guards. Such interactive training includes drills, operating instructions, and interactive testing of guard skills related to system components, software, hardware, and communication links.

The base station computer or CPU 30 accepts information from all checkpoint data processing subsystems 40 and 50, and any others in communications therein, stores the information in a database 34, provides access to this information to personnel in real-time mode and generates alerts if indicated by alert logic. Activity on the base station may be monitored in real time via a workstation monitor 32 or remotely (see FIG. 3A and FIG. 3B below). Furthermore, it is contemplated that checkpoint data processing subsystems 40 and 50 may not be computers in the literal sense, but may be replaced in certain situations with data processing units of varying sizes, complexities and configurations, including but not limited to handheld computing devices, PDAs and cell phones.

Another alternative configuration employs a cell phone as a checkpoint data processing subsystem, shown here in FIG. 2 as checkpoint cell phone 41. This cell phone may have an integrated or attached global positioning system GPS 43, which is in communication with a satellite 45 via a global orbital satellite communications system 47 in order to determine the geographical location of the cell phone 41. Cell phone 41 may also be in communication with one or more sensors within local area site 24, such as sensor 49. Additionally, cell phone 41 may communicate with other voice devices, such as other telephones, and the base station CPU 30 either through voice transmissions or data transmissions via cell tower 51 and a global computer network, such as the Internet 53.

Therefore, in operation with respect to FIG. 2, the security system may have additional types of checkpoints, such as mobile computers (PDAs, etc.) and cell phones. Each checkpoint is an intermediate device, which connects sensors to the Base Station and therefore each checkpoint has two main types of connections: (1) to the sensors, and (2) to the Base Station. The types of communications between these devices include direct communication and indirect communications as defined above. FIGS. 1 and 2 show examples of a few different configurations of the checkpoints within the overall system, and these configurations include:

Stand-Alone Fixed Base Station Computer

A checkpoint computer as a regular desktop computer connected to the Base Station Computer via direct or indirect communication. Examples of direct communication between the desktop checkpoint and Base station computer would be a wired local area network (LAN) or input/output ports. Examples of indirect communication between the desktop checkpoint computer and the base station would be the Internet or a LAN. The checkpoint computer is also connected to different sensors/devices including PDAs and cell phones via direct and indirect communication.

An example of sensors which connect via direct communication to the desktop checkpoint would be a hard-wired video camera and hard-wired temperature sensor. An example of device connected via indirect communication to the checkpoint computer would be a PDA which has wireless network adapter (see the Site A and Site B configurations in FIG. 1).

Mobile Checkpoint Computer—PDA

A checkpoint computer as a mobile computer (here a PDA) connected to the Base Station via direct or indirect communication, and to sensors via direct or indirect communications. An example of indirect communication between the mobile checkpoint computer and the base station would be the Internet or a local wireless network. The direct communication between a PDA and the base station would be used very rarely and only when the indirect communications mode is inaccessible. For example, when the wireless network is down, the checkpoint software installed on a PDA would start caching information from the sensor in the internal memory. Then it is possible to connect the PDA to a local area network via a network adapter, or directly to the Base Station computer via a USB cable, and send all the cached messages out.

An example of devices that connect to a mobile checkpoint via direct communication would be the GPS receiver and the Barcode Reader. The GPS receiver can be attached to the PDA (and/or cell phone) and receives current device geographical location information via Global Orbiting Satellite System, that is, the PDA receives messages from the GPS receiver, translates them and transmits them to the Base Station. The Barcode reader is also attached to the PDA device and reads barcodes, which code the desired location. Then the PDA receives messages (codes) from the Barcode reader, translates them and transmits them to the Base Station. An example of device connected to a mobile checkpoint via indirect communication would be a remote video camera which talks to PDA via a Bluetooth wireless protocol (see Site A, FIG. 1).

Mobile Checkpoint Computer—Cellular Phone

Another example is a checkpoint computer as a cell phone connected to Base Station via indirect communication, and connected to sensors via direct or indirect communications. An example of indirect communication between the cell phone checkpoint computer and the base station would be the Internet (for example, available through the cellular data network provider). An example of devices that connect to a mobile checkpoint via direct communication would be the GPS receiver and the Barcode Reader (as described above). An example of a device that connects to the cell phone checkpoint via indirect communication would be a wireless photo or video camera, which talks to the cell phone via a Bluetooth wireless protocol (see Site B, FIG. 1).

Figure 3A:
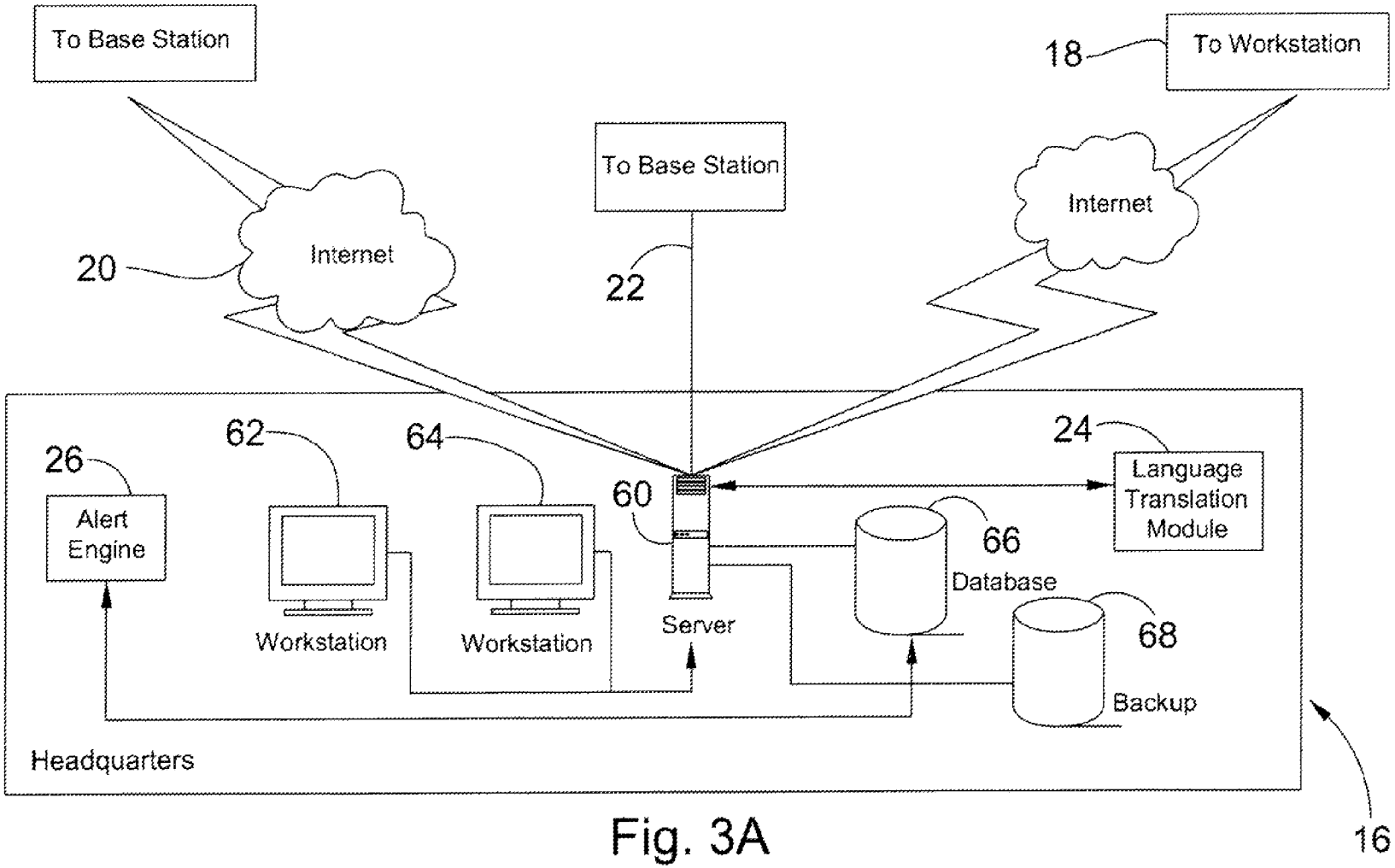
FIG. 3A is an enlarged detailed diagram of a base station located outside of the headquarters office with multiple workstations and hard wired as well as global computer network communications capabilities, constructed in accordance with the present invention.
Figure 3B:
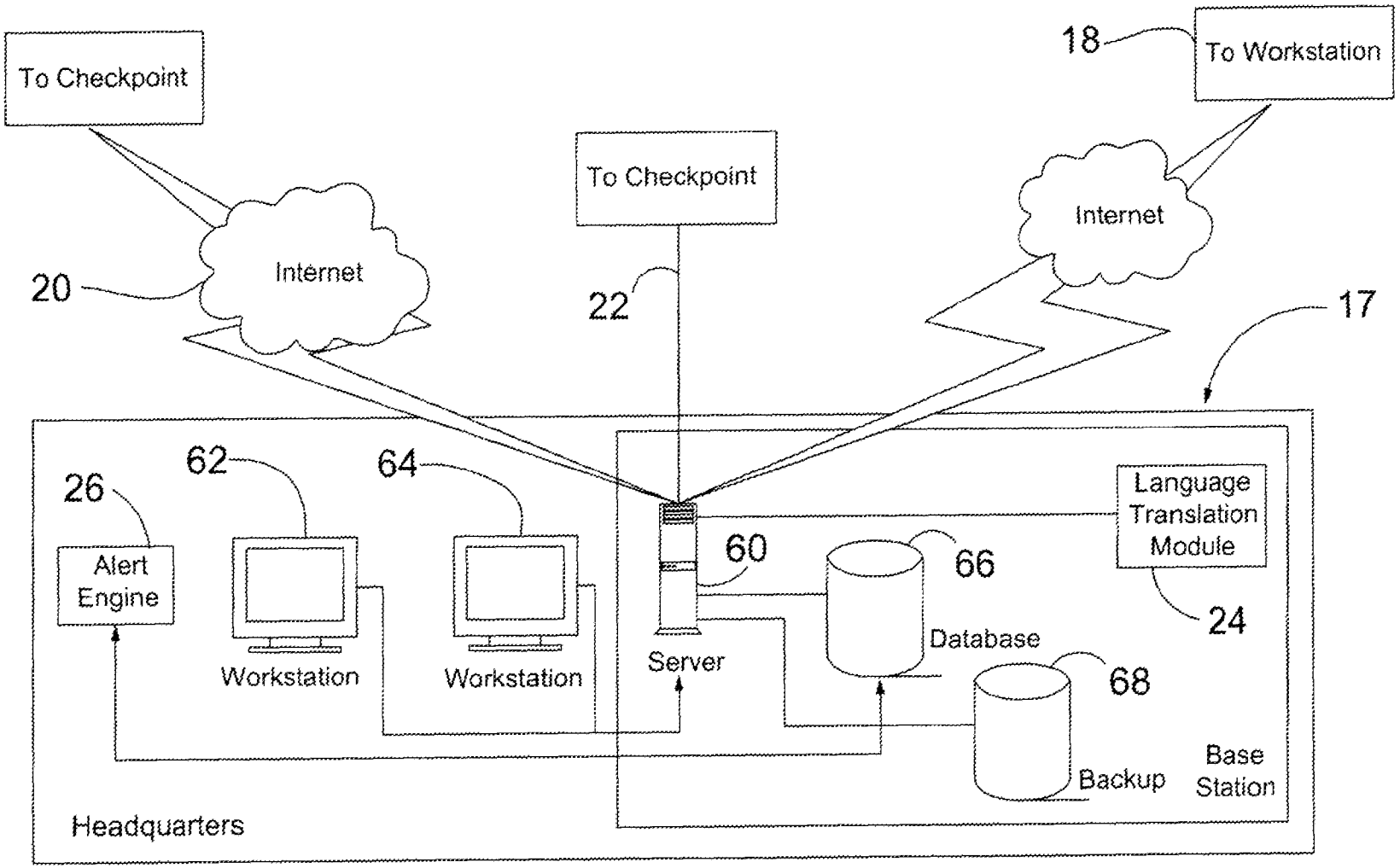
FIG. 3B is an enlarged detailed diagram of a base station within headquarters with multiple workstations and hard wired as well as global computer network communications capabilities, constructed in accordance with the present invention

Referring now to FIGS. 3A and 3B, there is shown two possible configurations of the headquarters server subsystem 16 and 17, one in which the headquarters subsystem communicates with base stations at a remote site (FIG. 3A), and one where the base station software components are installed on the headquarters server and there exists no site level base station computer or computers (FIG. 3B).

FIG. 3A illustrates a representational diagram of the integrated headquarters server subsystem 16. The headquarters server 60 is in communication with one or more of the base stations by means of a global computer network such as the Internet 20 or via a hard wired connection 22. The information from the headquarters server 60 may be viewed at headquarter workstations 62 and 64 or at widely remote workstations 18 by means of a global computer network (such as the Internet, satellite feeds) or by any other hard wired and/or wireless means.

The server subsystem 16 comprises a database memory unit 66 and a back-up database memory unit 68. All of the information generated by all other components of the security system 10 are stored within the database memory unit 66 and further backed up within database memory unit 68. This enables generation of reports aimed at the scheduling, planning, monitoring, controlling, tour event recording, sensed event recording and tracking of human security guards on duty at all of the guarded facilities (Site A, Site B, etc.) and other monitored sites. Furthermore, real time monitoring of events within secure facilities is recorded to enable faster, more effective use of guard supervision, decision-making, intrusion intervention and deployment, among many other contemplated guard tasks.

Therefore, in FIG. 3A, the Base Station Software resides on remote computers located outside of the Headquarters office and data is being synchronized between the central database located at Headquarters office and outside local databases. In this scenario described in FIG. 3A, the system can function independently locally without having any connection to the central Headquarters office, with the primary benefit being that guards and local supervisors have full control over what's happening within a site even if the connection to the Headquarters office is down.

FIG. 3B shows another possible configuration for configuring the Headquarters and the base station, with respect to headquarters server subsystem 17. In this scenario, the headquarters server 60 has some or all of the base station software components installed. In this configuration, no base station computer or computers exist at the site level. The Checkpoints are transmitting information directly to the headquarters server, and base station software components within the headquarters server 60 receive and process that information, and then store it in the headquarters database 66 and backup 68 directly. This configuration is used for the sites that do not have a heavy traffic and the cost of installing and maintaining of the base station computer would be much higher than the cost of keeping the base station software components at the headquarters server computer.

Therefore, FIG. 3B shows an alternative scenario, that is, one in which the Base Station resides within the Headquarters office and directly writes messages received from Checkpoints into the central database. In the scenario described in FIG. 313, the system relies on having an active connection to the Headquarters office via the Internet 20. When the connection is down, all information received from sensors is cached at the Checkpoint level and will be transmitted to the Headquarters office as soon as a connection to the Headquarters is re-established. The benefit is that very limited installation needs to be done and maintained on local sites and the cost is minimal. Another benefit is that information of significant importance can be shared between all desired sites almost instantaneously.

Figure 4:
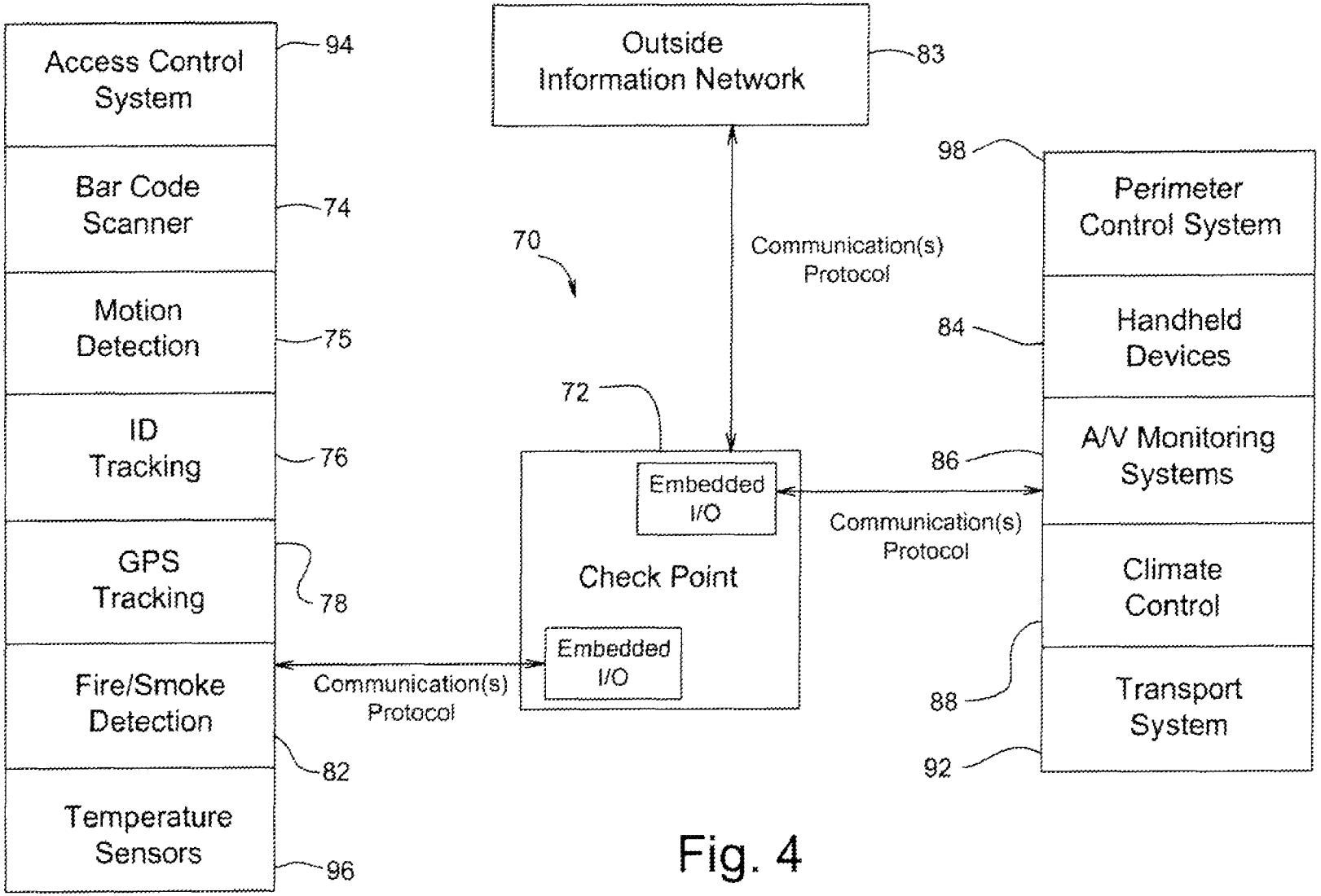
FIG. 4 is a block diagram of the checkpoint data processing architecture and communications system between the security system event sensors and said checkpoint data processor, in greater detail, constructed in accordance with the present invention.

A schematic diagram of checkpoint computer communications options 70 is illustrated in FIG. 4. Another embodiment of a checkpoint computer 72 receives and records information from peripheral event sensor equipment. Most of these devices, such as an access control system 94, a bar code scanner 74, a motion detection device 75, an identification or ID tracking device 76, a GPS tracking system or tracking device 78, a temperature sensor 96, a fire and smoke detection device 82, perimeter control systems 98, a hand held device 84 such as various security guard communications equipment or a PDA-type device, video camera subsystems 86, climate control subsystems 88 such as heating ventilating and air conditioning (HVAC) subsystems, and transport subsystems 92 such as elevator control device, will all send information instantly and simultaneously to the checkpoint computer 72 by means of a security system communications protocol through an embedded Input/Output (I/O) microprocessor, as shown within the checkpoint computer 72.

Sensor specific communication protocols, for the purpose of collecting data from sensors, may be developed and deployed for each project. Alternatively, existing software components will be customized or interfaced with to allow communications between the sensors and the checkpoints. The universal communications protocol, comprised of an encrypted XML-enabled proprietary software program, will direct communications between the checkpoint data processing subsystems or checkpoint computers and the base stations as well as any headquarters servers deployed within the system (see FIG. 5 and FIG. 6 below).

Furthermore, as illustrated in FIG. 4 an outside information network 83 will communicate directly with the checkpoint computer 72. The outside information network 83 represents external shared information sources such as a weather website, a news website, other informational broadcast channels, etc. The present security system will consider those outside information sources as a special type of "sensor" within the system. Information obtained in this way will contribute to the overall security monitoring and alert notification within and outside the site, or within the network of monitored sites. Additionally, the security information may be translated into local dialect or language and selectively sent out to public safety agencies, government offices, school campuses, communities, globally and beyond.

The security system may be customized to meet local requirements. For instance, the security system may be capable of disseminating real time information throughout the system in different formats that reflect local languages and idioms, local alphabets, local cultural conditions, and local laws and regulations.

Figure 5:
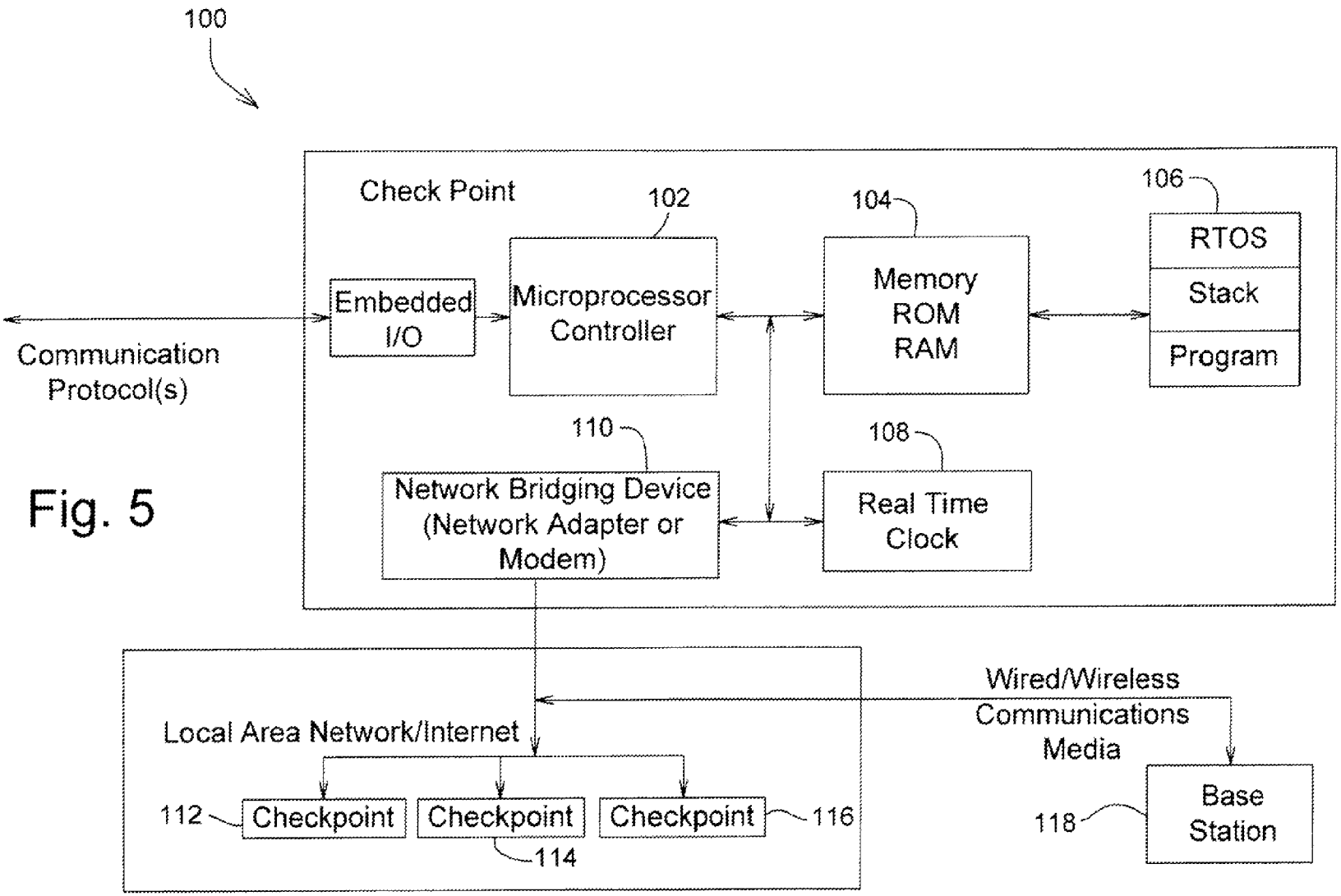
FIG. 5 is a block diagram showing the checkpoint hardware architecture in greater detail, including communications routes between numerous checkpoint data processing units and a base station, constructed in accordance with the present invention.

FIG. 5 is a block diagram of the checkpoint computer hardware architecture in greater detail 100. The CPU microprocessor controller 102 converts the incoming and outgoing signals by means of application software, which is stored in the memory (ROM and RAM) 104 of the checkpoint computer. The real time operating system RTOS/Stack/Program module 106 and the real time clock 108 will run the software independently. Each checkpoint 100 will be equipped with a Network Bridging Device 110 including but not limited to a network adapter, an Ethernet controller, a WLAN controller, a phone modem, a cellular modem, etc., which will allow communications via a local area network (LAN) or a global computer network (the Internet) on site between other checkpoint computer systems such as checkpoint data processing subsystems 112, 114 and 116, and the sensors, controllers and other devices within each of those checkpoint computers range of operations.

Communications within the local area network (LAN) or a global area network, such as the Internet, linking the checkpoint data processing subsystems together, and the base station CPU 118 is accomplished either by means of hard wired or wireless communications media. It is also contemplated that these communications may be directed over existing power lines in and around the guarded facilities. By using the existing power supply and routing lines, the security system can be readily integrated into almost any environment, facility or site, which includes any existing power supply lines into or out of the building, campus or complex.

Figure 6:
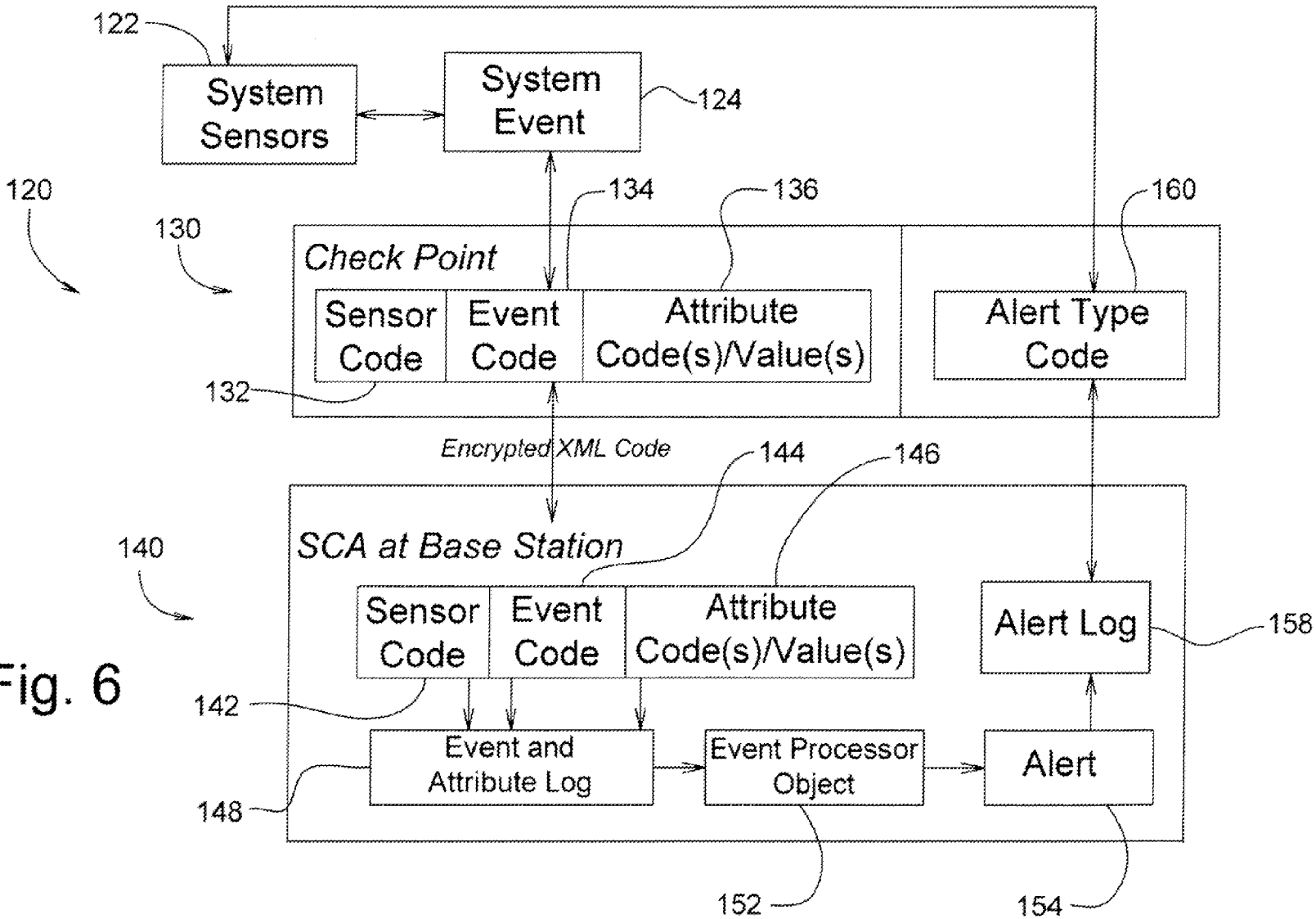
FIG. 6 is a block diagram of an integrated security system encrypted XML communications protocol illustrating communications between system sensors, checkpoint data processing units and the system core application at a base station, constructed in accordance with the present invention.

Turning now to FIG. 6, there is illustrated a block diagram of an integrated security system encrypted XML communications protocol 120 exemplifying communications between checkpoints and the system core application at a base station, as constructed in accordance with the present invention. The system sensors 122 communicate any (and all) system event 124 to a checkpoint 130 via a custom protocol. A sensor code 132 identifies the sensor device that transmitted the system event 124. An event code 134 identifies the actual event and attribute code(s) and value(s) 136 together describe software values for the system event 124 and each individual system event as reported. Each system event 124 can have several attributes. The value of an attribute could be anything from an integer, a string, an image or other data file.

The attribute code(s) and value(s) 136, together with associated sensor code 132 and event code 134 for a given system event 124, are detected and processed by the checkpoint encrypted XML communications protocol software which generates the encrypted XML message which can then be transferred over the network, LAN or a global computer network such as the Internet. After the encrypted attribute code(s) and value(s) 146, sensor code 142 and event code 144 have been received by the security system core application (shown as SCA in FIG. 6) at the base station (shown as Base Station in FIG. 6) 140, the SCA at Base Station will process and decrypt the incoming XML message. The event code 144 and the sensor code 142 will generate an event in the event log and attribute log 148.

Meanwhile, an Event Processor Object 152 will also receive XML messages and process them. For example, the Event Processor Object 152 will compare the attribute code values to those of the alert values stored in the database and generate an alert 154 accordingly. The alert 154 is then stored in the alert log 158. With the three basic elements, sensor code 132, event code 134 and attribute codes 136, it is possible to describe the communication between the base station CPU 30 and the checkpoint computer 40 for any type of device. Therefore, once programmed, using the encrypted XML protocol 120, the integrated security system can communicate with any off the shelf security device, such as motion sensors, etc., as well as with any facilities subsystem monitoring devices, such as climate control or fire and smoke detection devices. The specific functioning of this Event Processor Object 152 is such that the processing of the events that come from the sensors now does not have to be done in the database, but at any appropriate level within the application architecture.

An Alert Type Code 160 component is in bi-directional communication with the system sensors 122 and the alert log 158 at the Base Station 140. In operation, the Alert Type Code 160 brings an alert from the base station level to the checkpoint level, and if necessary, to the sensors. When an alert is created in the Base Station 140, it needs to be delivered to people and/or devices that are responsible for handling that type of the alert. In order to do that it gets wrapped into the XML message and sent to the desired checkpoint (or multiple checkpoints, if necessary). Then checkpoint software decides how the alert needs to be handled, for example generate a visual display for a human guard to view, make a sound signal, or provide a specific programmed in sensor response/behavior (turn on lights, etc.).

One example is the response to a guard entering a room he is not authorized to enter. First, a Wi-Fi identification system would sense the guard in the room, and send an event signal "Guard A is in the Room X" to the base station. The event signal will be processed and stored in the database in an event and attribute log. Then the Event Processor object compares the event with the existing access rules and identifies that the situation is abnormal, and an alert needs to be generated. It generates a new alert and stores it in the Alert Log.

Next, the Base Station XML protocol software takes this alert, packs it in the standard XML message and sends to the checkpoint that have "Room X" sensors connected. The checkpoint receives the alert, process it and send a command to the "Alarm" sound system. Another alternative to handling the alert would be to send it to the desired backup guard or other personnel, that is, to the particular mobile checkpoint presently in that person's possession.

Figure 7:
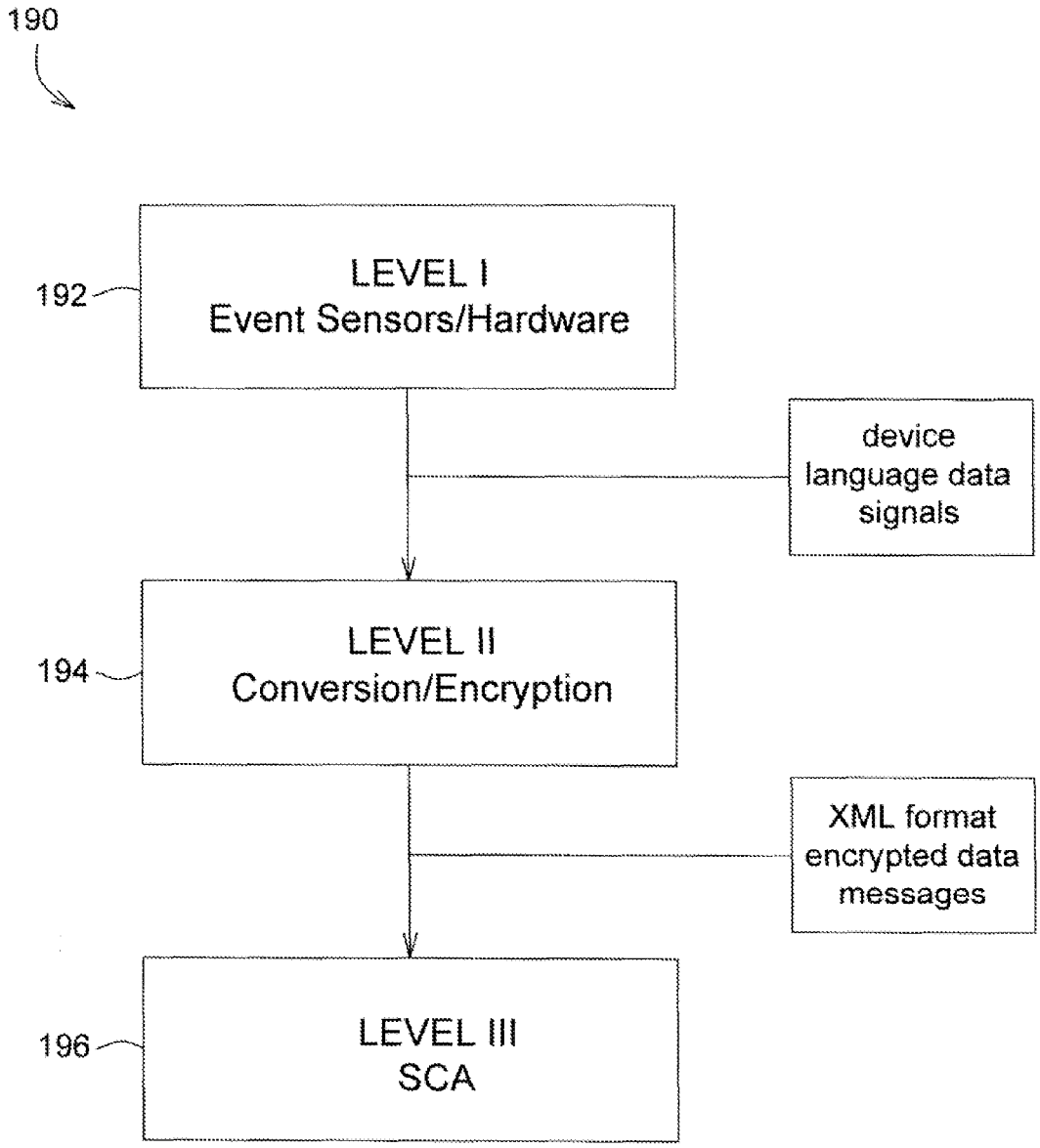
FIG. 7 is a block diagram illustrating the three basic levels of architecture in the strategy and functioning of the overall method and protocol for real time security system communications.

FIG. 7 is a block diagram illustrating the three levels of architecture of the strategy and functioning of the overall method and protocol 190 for real time security system communication. There are three levels of organization within the protocol. Level I 192 includes the security site sensors, other installed security and environmental monitoring hardware devices and any embedded computer systems as well as low-level software components (drivers) to communicate to these hardware devices. Level II 194 includes the security site checkpoint software (and checkpoint computers and devices). Level III 196 includes the site base station software (and computers and any off-site headquarters computers, and any other off site computers.

Referring now to FIG. 7, in operation, under Level 1192, security devices and sensors transmit data in device language specific for that device or sensor. Under Level II 192 a checkpoint data processing unit collects data messages from various site security devices and sensors in unique device language and translates these messages into standardized messages to be passed on to the SCA. This is accomplished by generating a message based upon converted coded data messages and transmitting the converted messages to computers containing the SCA.

Under Level III 196, base station software components installed on the base station computers and/or off site headquarters computers, or any other off site computers, such as remote workstations, analyze the coded transmitted messages whereby such analysis is used to generate reports and logs for the purpose of effectively monitoring the environmental and security conditions within a subject site.

Therefore, Level I 190 operations include data transmission from any number of existing, or yet to be created, security devices and event sensors, either off the shelf units and/or customized combinations, all having their own specialized and unique device language transmitting components and qualities. In this regard, the present invention can be programmed to receive all of the data message formats originating from any and all of these devices, then be integrated into any site for security and/or environmental monitoring in a customized and readily scalable fashion.

Figure 8A:
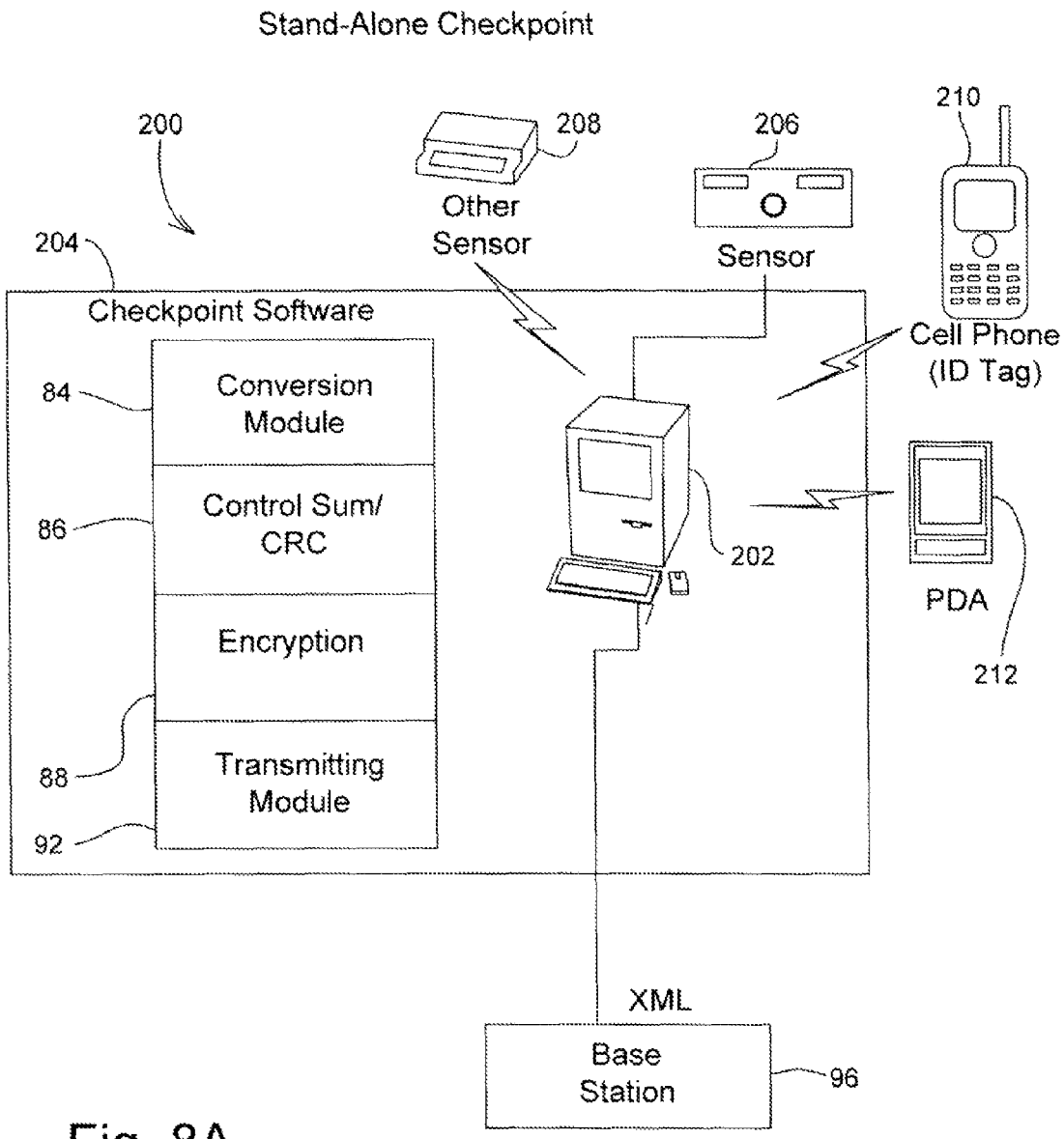
FIG. 8A is a diagram that shows a stand-alone checkpoint computer processor, wherein the checkpoint software is housed within that stand alone computer processor.
Figure 8B:
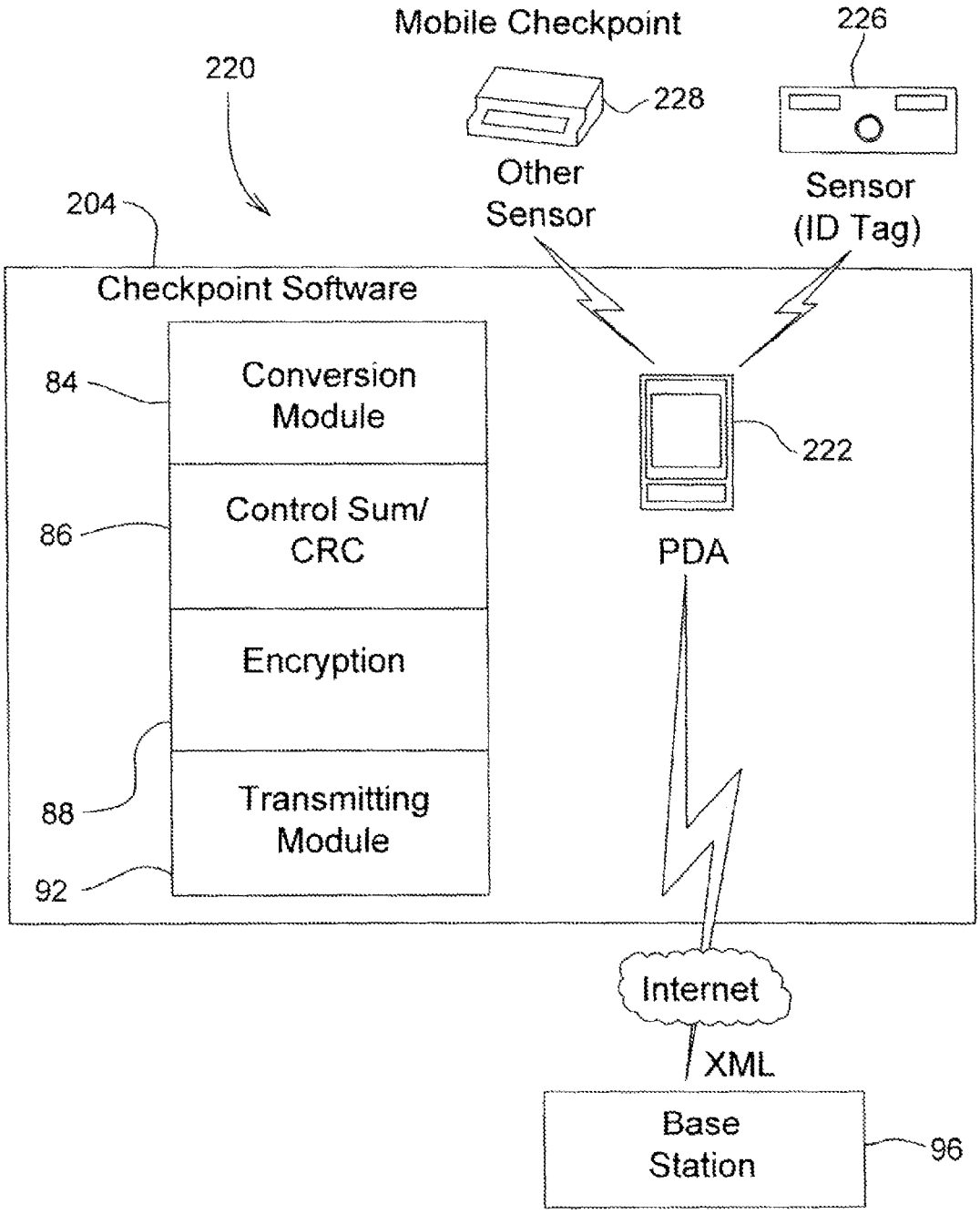
FIG. 8B is a diagram of a mobile checkpoint computer processor, wherein the checkpoint software is housed within that mobile computer processor.
Figure 8C:
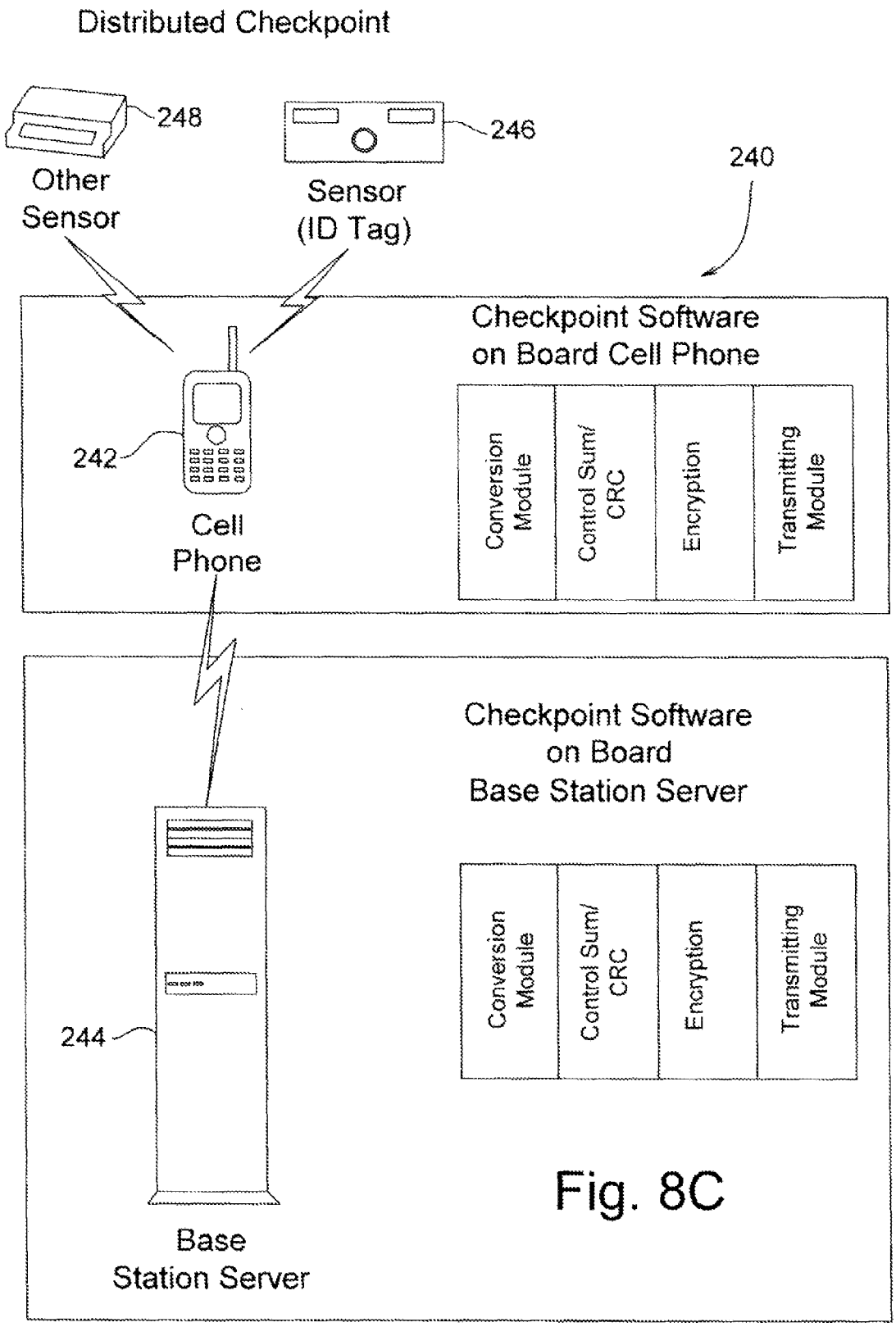
FIG. 8C is a diagram of a distributed checkpoint with checkpoint software partially on board both a cell phone as an example of a mobile checkpoint, and partially on board a base station server as an example of a fixed checkpoint.

FIGS. 8A, 8B and 8C are diagrams that illustrate some of the possible different configurations of the checkpoint hardware and the location of the checkpoint software. It shows in greater detail at least three different architectures of the checkpoint with respect to both software and hardware.

FIG. 8A illustrates a simple stand-alone checkpoint 200, including a checkpoint computer 202. The checkpoint software 204 comprises a conversion module 84, a control sum/CRC module 86, an encryption module 88 and a transmitting module 92. In this configuration, the checkpoint software 204 is installed on the checkpoint stand-alone computer 202 located either at the security alert monitored site or in the headquarters office. Sensors 206, other sensors 208, one or more cell phones or radio frequency ID tags 210, and PDAs 212 are all in communication with the checkpoint computer 202. The checkpoint computer then communicates with the Base Station 96 using an XML language based protocol.

In FIG. 8B, there is illustrated a simple mobile checkpoint 220 comprising a PDA 222. The checkpoint software 204 is completely installed on a mobile computer checkpoint, such as PDA 222, which is connected via a wireless local network to the sensor ID tag 226 and other sensors 228, and to Base Station 96 via the Internet using an XML language based communications protocol. The base station 96 is optionally located at the same site as the mobile checkpoint or at the off site headquarters office.

FIG. 8C illustrates a distributed checkpoint configuration 240 wherein some or all of the checkpoint software modules (described above) are installed on board a mobile checkpoint computer/device 242 (such as a cell phone, PDA, etc.). At the same time, some or all of the checkpoint software is installed on board a stand-alone checkpoint computer 244, such as the Base Station server, as shown here, located on the same site, or at the headquarters office. The mobile computer/device 242 communicates with the sensor ID tag 246 and the other sensor 248 via a wireless network, receives messages, creates a message in an intermediate format, encodes the messages and transmits them to those modules of the checkpoint software residing on the stand-alone checkpoint computer 244. Those modules of the checkpoint software residing on the stand-alone checkpoint computer 244, receive the messages, decode them and pack them into specified XML messages to be used to generate specific security alerts.

Figure 9A:
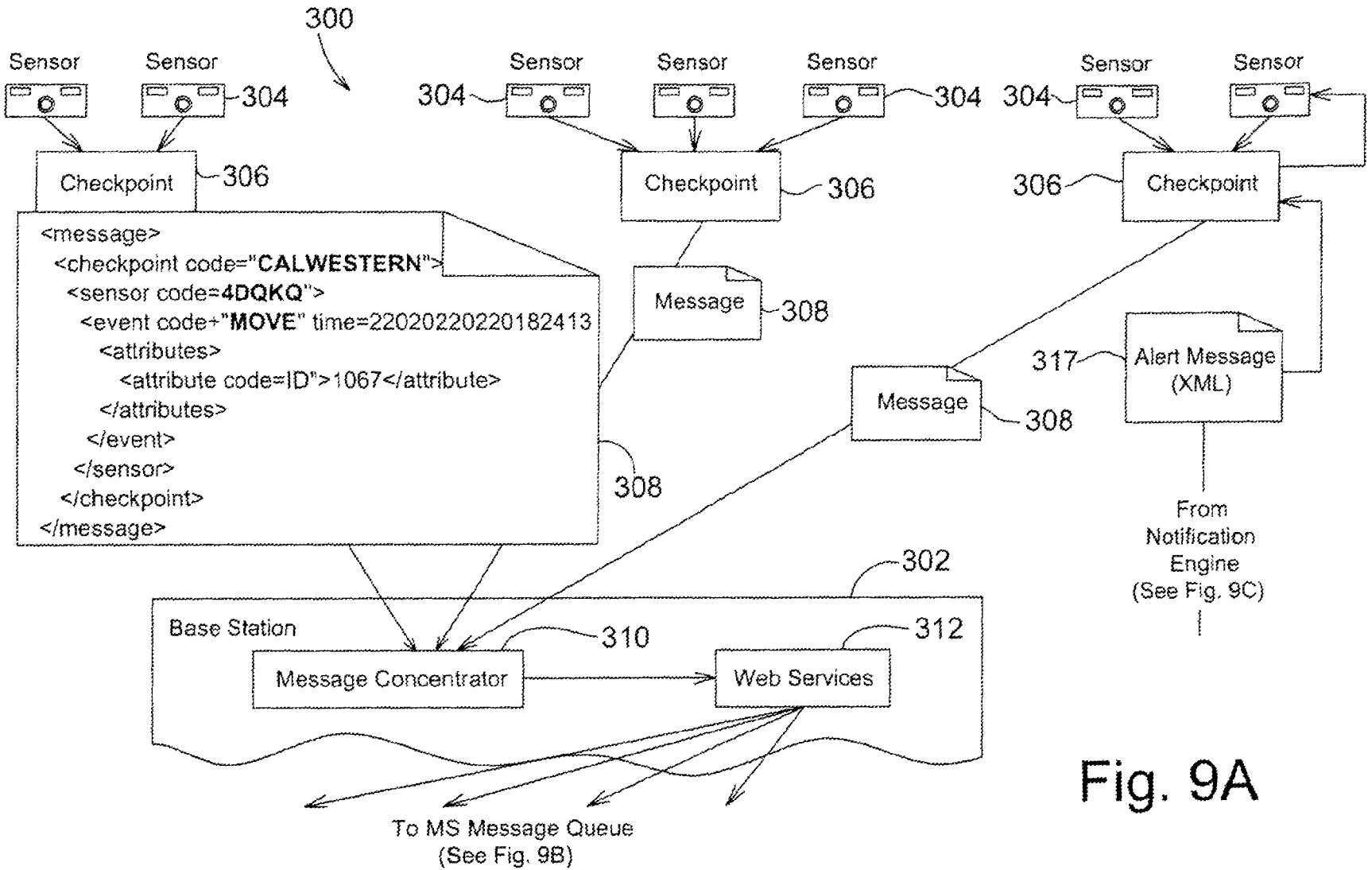
FIG. 9A is a block diagram of the site devices and base station modules illustrating the architecture and data flow between sensor input devices and checkpoints, and checkpoints to the base station message concentrator, constructed in accordance with the present invention.
Figure 9B:
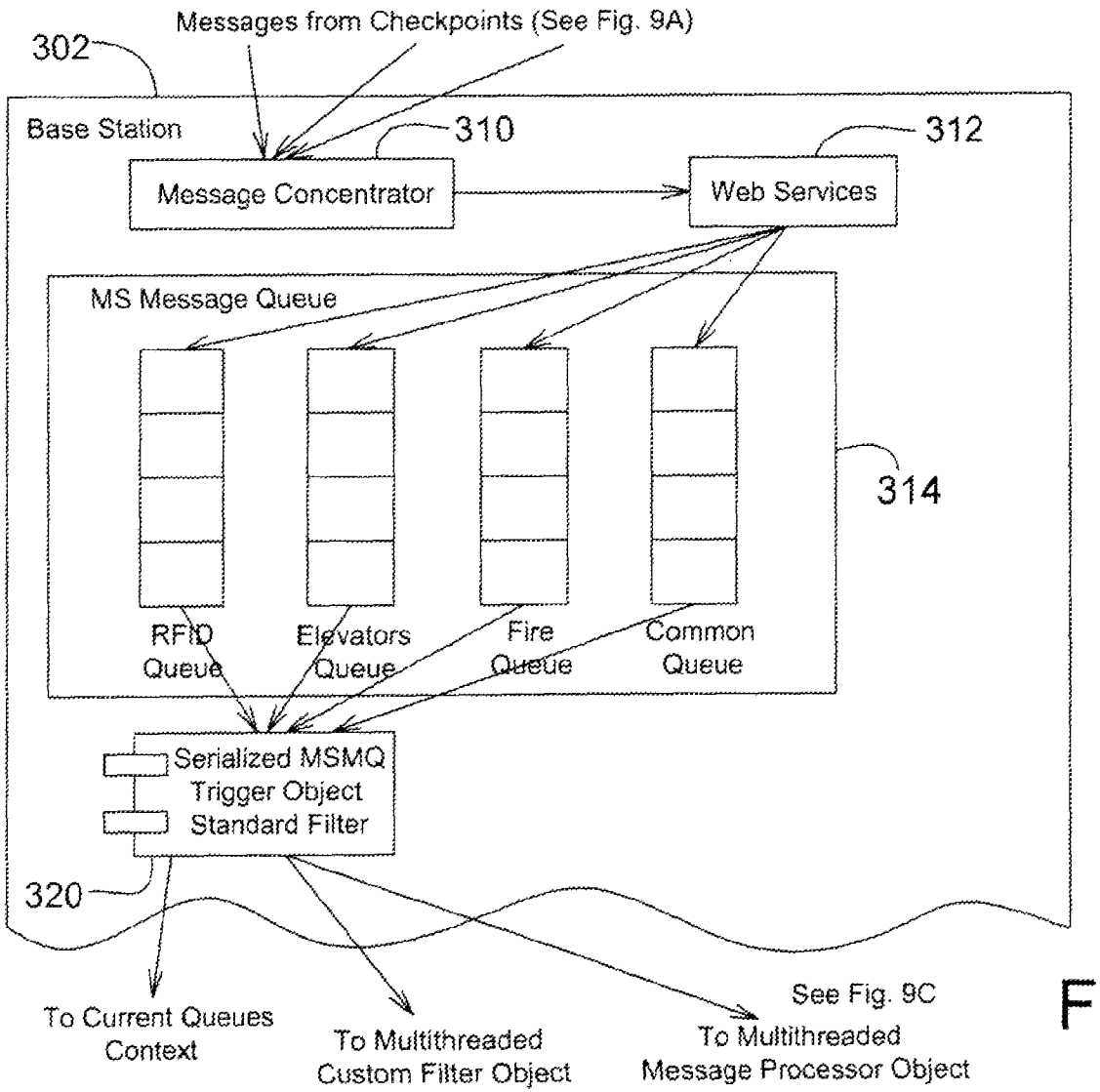
FIG. 9B is a block diagram of the base station modules illustrating the architecture and data flow between various modules within the system base station, constructed in accordance with the present invention.
Figure 9C:
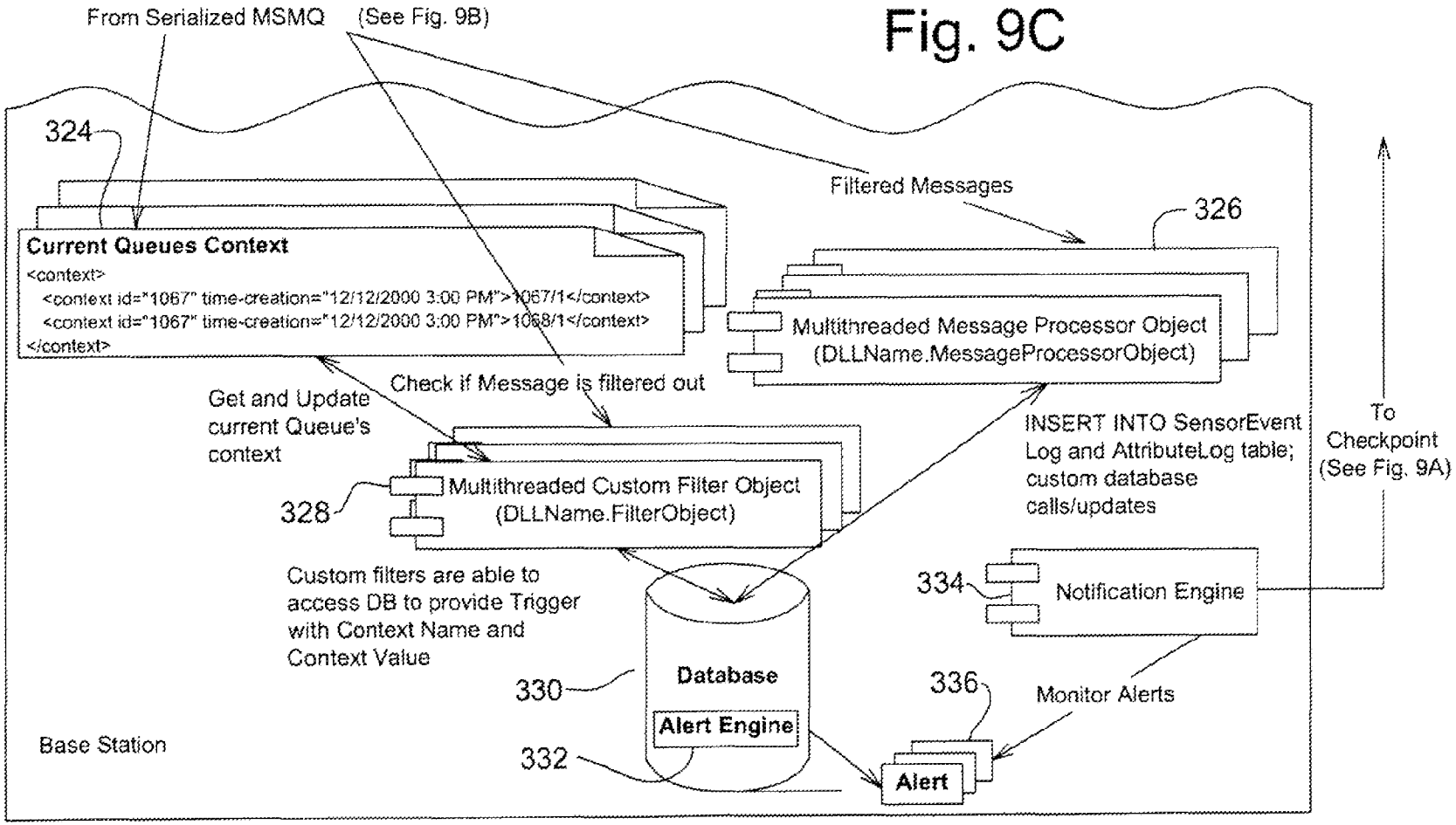
FIG. 9C is a block diagram of the base station modules illustrating the architecture and data flow between various modules within the system base station controlling alert monitoring and notification, in accordance with the present invention.

FIGS. 9A, 9B and 9C show the architecture and data flow of the entire system, especially with respect to message and alert generation, routing, monitoring and notification. The core of the system consists of the Message Queuing and Processing software modules 300 located within the Base Station 302.

Referring now to FIG. 9A, in operation, one or more sensors 304 continuously monitor for specific events. These sensors are in communication with one or more checkpoint computers 306, referred to hereinafter as "checkpoints." Upon the occurrence of an event, sensors 304 picking up said event then relay information regarding that event to the checkpoints 306. The checkpoints 306 receiving such information then generate messages 308 and these messages 308 are sent to the Base Station 302, more specifically to the Message Concentrator module 310 therein. The Message Concentrator 310 then sends information regarding the messages to a Web Services module 312 within the Base Station 302, which in turn relays said information to a Microsoft® (MS) message queue 314. This MS message queue 314 contains one or more event type specific queues (see FIG. 9B where four separate queues are shown as an example. Checkpoints 306 are also capable of receiving Alert Messages 317 in XML language from an Alert Notification Engine 334 (shown in FIG. 9C).

Referring now to FIG. 9B, every event type specific queue within MS Message Queue 314 handles one or several types of events. Here queues for radio frequency ID tags, elevators, fire and a common queue is shown. Messages from the hardware are sorted by Event Type, queued in a corresponding Queue and processed independently from the different types of messages, using XML Configuration File 318, as follows:

```
....
<Queues>
 <Queue Name="q1".....>
  .....
  <Events>
   <Event Code="MOVE" />
   <Event Code="HIT" />
```

-continued

```
  </Events>
 </Queue>
 <Queue Name="q2".....>
  .....
  <Events>
   <Event Code="FIRE" />
  </Events>
 </Queue>
</Queues>
....
```

The Message Concentrator 310 is a Windows based application that "listens" to a TCP/IP port for the incoming messages. Checkpoints 306 send event messages 308 generated by hardware sensors 304 to those ports in described XML format. When the Message Concentrator 310 receives an XML message it calls a Web Service 312. When the Web Service 312 receives a message it looks up which Queue it should be placed to and creates a new MSMQ message in the queue.

Every Queue has a Message Queuing Trigger object 320 assigned. Message Queuing triggers 320 allows the system to associate the arrival of incoming messages at a destination queue with the functionality of one or more COM components or stand-alone executable programs. These triggers can be used to define business rules that can be invoked when a message arrives at the queue without the need for any additional programming.

Referring to FIG. 9C, in operation, a trigger object performs two distinct steps: (1) it calls a filter object 328 to determine if the message should be processed or filtered out. For example a fire control sensor generates an "OK" event every two seconds. There are one hundred fire sensors installed in a building. If the system would process, analyze and store all those "OK" events that would create a huge overhead and take a lot of memory and disk resources. It is reasonable to filter out most of the events, and record only one "OK" event every set number of minutes, or some other pre-programmed unit of time; and (2) if the filter returns that the message should be processed, it calls a message processor object 326 that implements custom logic on how this type of event should be processed and stored in the database. For example, for a "Person Identification" event, the processor object will insert records into SensorEventLog and AttributeLog first, and then call the "UpdateTourLog" stored procedure to match the message with the prescheduled Tour Log for that given shift.

Each Filter object takes an XML message, analyzes it and tells the Trigger if the message should be processed and stored in the database. In order to do that, a Filter should have access to recent history of the processed messages. This history is called Context and it is stored in XML format in memory in a Current Queues Context module 324.

Every Queue has its own Context. Context is defined by Context ID—a combination of attributes that identify records in the Context related to "the same entity" as the processed message by the Filter, and Context Value, or state—a combination of the attributes that should be compared with the current message to decide if the message is identical to the Context's message.

Within database 330 is the Alert Engine 332 which is constantly monitoring new events to check them against the predefined rules within each site. When an abnormal condition is detected, the Alert Engine 322 creates a new alert 336 in the Alert Log.

The Notification Engine 334 is constantly monitoring the alerts 336 in the Alert Log. When a new alert 336 is created or a current alert status is changed, the Notification Engine 334 sends an alert message in XML format to the desired (by location or by owner) checkpoint 306 (see FIG. 9A).

Additionally, this system can be used to train security personnel. This training may include interactive training of the guards which further includes event drills, operating instructions, and interactive testing of guard skills related to system components, software, hardware, and communication links. In this regard the security system actually enhances its own operation by making the human guards better educated and better trained.

Examples of XML Communication Protocol Operation

One focus of the instant invention is on the communication between the checkpoint computers and the base station (BS). The main concept of the protocol between checkpoints and BS's is determined by three elements, the sensor code, the event code and the attribute codes. The sensor code is the identification of the sensor/device that produces a particular event. The event code is the identification of the actual event that happened. The event code, together with the sensor code is unique and will be logged in the event log. The attribute codes are attributes of the event code and describe values for the event. Each event can have several attributes. The value of an attribute could be anything from an integer to a string to an image or other data.

Two versions of the XML format have been suggested: extended format and compressed format. Below is a sample how the same message will be coded in both standards.

Let us consider a movement sensor, for example. At 10:23:15 a guard passes a movement sensor with sensor code "1234." The event code is described as "movement." This particular data is gathered in the checkpoint. The checkpoint software will then generate the XML code, which would look like this:

1. Extended Format:

```
<message>
<sensor code = "1234"
<event code = "movement">
<Attributes>
<attribute code="state" value="active"
<attribute code="time" value="10:23:15"
</attributes>
</events>
</sensor>
</message>
```

2. Compressed Format:

```
<message>
<event code = "movement">sensor=1234;state=active;time=10:23:15</
event>
</message>
```

The generated code by the checkpoint could be encrypted (see security protocol) in order to keep the information undisclosed while it is transferred over the network or interne. After these 3 elements have been received by the BS, the SCA will process and decrypt the incoming XML code. The "event code" and "sensor code" will generate an entry in the event log. An SQL trigger or stored procedure will process the attributes of the event. They will compare the attribute values to the alarm values stored in the database and generate an alarm event accordingly. The alarm event is stored in the alarm log.

SPECIFIC EXAMPLES

With the three basic elements, sensor code, event code and attribute codes, it is possible to describe the communication between the BS and the checkpoint computer for any type of device.

Example 1

At 1:00 AM a window breaks on the 5$^{th}$ floor of a building. The detector has code "1111."

1. Extended Format

```
<sensor code = "1111 "
<event code = "window broken"
<attributes>
<attribute code="state" value="active">
<attribute code="time" value="1:00 AM">
<attribute code="floor" value="5 ">
</attributes>
</events>
</sensor>
```

2. Compressed Format

```
<message>
<event code = "window broken">
sensor=1111;state=active;time=13:00:00;floor=5
</event>
</message>
```

The attributes make it possible to send an indefinite number of information items about the event that occurred.

Example 2

Suppose a tenant wants to access room 5 of a building. The access to the room is secured with a keypad, which asks for a password and user name. The flow of events will be as follows:

Information about entered keypad information is sent to the checkpoint over a field bus. The checkpoint processes the received data and generates the XML code:

1. Extended Format:

```
<sensor code = "Authorization procedure"
<event code = "login">
<attributes>
<attribute code="Username" value="User1 ">
<attribute code="Password" value="Guest">
<attribute code="time" value="3:00 PM">
<attribute code="room" value="5 ">
</attributes>
</events>
</sensor>
```

2. Compressed Format

```
<message>
<event code = "login">
sensor=Authorization procedure; username=user;password=Guest;
time=3:00PM;room=5
</event>
</message>
```

The XML code is encrypted by the checkpoint and transferred to the SCA on the BS.

The SCA will decrypt the XML code and process the information. The access rights of this particular person will be checked in the database.

The SCA produces XML code

1. Extended Format

```
<sensor code = "Authorization procedure"
<event code = "login">
<attributes>
<attribute code="Validation" value="granted">
<attribute code="time" value="3:00 PM">
<attribute code="room" value="5 ">
</attributes>
</events>
</sensor>
```

2. Compressed Format

```
<message>
<event code = "login">
sensor=Authorization procedure; Validation=granted;time=
3:00PM;room=5
</event>
</message>
```

The SCA will encrypt this code and send it to the checkpoint.

The checkpoint decrypts and processes the received XML code and opens the door.

Example 3

If for example the door access would be secured with fingerprint or eye detection the code would look as follows:

1. Extended Format

```
<sensor code = "Authorization procedure">
<event code = "login">
<attributes>
<attribute code="Fingerprint Data" value= "01100101001001010
10010010010010010
01010010010010010
00101001001001011
10101010101010010
010010000101111 ">
<attribute code="time" value="3:00 PM">
<attribute code="room" value="5 ">
</attributes>
</events>
</sensor>
```

2. Compressed Format

```
<message>
<event code = "login">
sensor=Authorization procedure; Fingerprint=01100101001001010
10010010010010010
01010010010010010
00101001001001011
10101010101010010
010010000101111; time=3:00PM;room=5
</event>
</message>
```

Extended Format Versus Compressed Format

In the original extended version each attribute is represented by separated XML tag, and each message contains a Checkpoint code (a code unique to the checkpoint which sent the message). In the compressed format version all information is "compressed" in one string and located inside the <event> XML tag.

The first version of the protocol will provide a faster processing time on the server through extensive use of XML parser. The XML parser will validate message syntax and automatically load a whole message into XML object model. When the security system is operating on a local network, and has a large number of different sensors sending messages in real-time, the priority is faster processing. Also, when the extended version of the protocol is employed, one can validate if the message has been sent from the correct checkpoint, that is, if the checkpoint is authorized to send the messages from that particular sensor.

The second compressed version of the protocol is processed slightly slower, while decreasing the message size significantly. This is very important for the sites where a broadband application for data transfer is limited or shared. For example, when the security system is used on a cellular network to send data from the cell phones, the priority would be to minimize message size.

Security Protocol

There are several possible levels of security that could be applied in the integrated security system and SCA.

One of them is already implemented in the application as it is described herein. Clients will have to enter a username and password when entering the SCA as follows: (1) when a user logs in, the SCA creates a SessionID which is a unique value (GUID). The SCA then encodes UserName and SessionID using 128 bit key and puts these three strings (UserName, SessionID and an encoded UserName+SessionID) into a cookie, which is sent to the client with an HTML page; and (2) when a client sends/requests any data to/from a SCA page on a web server, the SCA takes these three strings from the cookie, encodes UserName and SessionID using the same key and compares the result with the encoded string from a cookie.

The SCA then determines the access rights for this particular client. These access rights will determine to what particular parts of the SCA, the client has access and if he can edit or just view data.

The mentioned 128 bit key could also be used to encrypt the XML code that is used for communication between the BS and checkpoints. This will have to be looked at on an individual basis and will be further customized depending upon client needs.

On top of the security that is already built into the SCA, it is possible to provide extra security by using so called Secured Socket Layer (SSL) Web Server Certificate.

Finally, as defined herein, the term "stations" may include one or more base stations, and one or more headquarters.

It should be understood, however, that even though these numerous embodiments, examples, characteristics and advantages of the invention have been set forth in the foregoing description, together with details of the structure and function of the invention, the disclosure is illustrative only, and changes may be made in detail, especially in matters of shape, size, components, configuration and arrangement of parts within the principal of the invention to the full extent indicated by the broad general meaning of the terms in which the appended claims are expressed.

The invention claimed is:

1. A security system, comprising:

a checkpoint system configured for receiving, processing, and relaying data received from peripheral equipment comprising at least one of a plurality of sensors, video cameras, positioning systems, and mobile communication and data processing equipment, and providing a human with information based on the data; and a base station configured for logging, processing, and reporting the data relayed from the checkpoint system to provide a security system status and to facilitate human supervision, situation analysis, decision making, and intervention; and a computer-implemented communication system that translates security alerts associated with the data to a local dialect or language and directs the alerts to the human by way of the checkpoint system.

2. The security system of claim 1, wherein the checkpoint system comprises at least one of a mobile computer, a personal digital assistant, and a cellular telephone in direct communication with the base station.

3. The security system of claim 2, wherein the checkpoint system further comprises an optical code reader.

4. The security system of claim 1, wherein said information is an alert, a message, or a set of instructions.

5. The security system of claim 1, further comprising:

a headquarters station:

wherein the base station receives the data from the checkpoint system, stores the data in a database, provides human access to the data, generates alerts if prompted by a base station software program, and communicates with said headquarters station; and wherein said headquarters station comprises a database memory unit and a back-up database memory unit, said headquarters station facilitating human guard supervision of environmental and event-related activities, human guard situation analysis, human intervention, and activation of security countermeasures, including preventing, deterring, and mitigating criminal acts, responding to terrorist threats and attacks, war acts, riots, civil unrest, political events, structural failures, power failures, electronic failures, adverse weather, fire hazards, seismic events, variations in temperature and light conditions, and hazardous conditions requiring situation assessment and countermeasures.

6. The security system of claim 5, wherein the base station and the headquarters station are situated in different geographical areas, the base station being situated in the proximity of said peripheral equipment, and said headquarters station being situated in a location remote from the base station.

7. The security system of claim 5, wherein the base station is integrated with the headquarters station.

8. The security system of claim 1, wherein the communication system operates with XML language in a compressed format.

9. The security system of claim 2, wherein the checkpoint system further comprises a global positioning system receiver.

10. The security system of claim 1, wherein the communication system is configured to translate the alerts in accordance with local laws and regulations.

11. The security system of claim 1, wherein the communication system is configured to translate the alerts using local alphabets.

12. The security system of claim 1, wherein the checkpoint system is further configured for processing data received from peripheral equipment into a standardized protocol.

13. The security system of claim 1, wherein the checkpoint system is integrated with a mobile computer.

14. The security system of claim 13, wherein mobile computer is integrated with at least one of a mobile computer, a personal digital assistant, and a cellular phone.

15. The security system of claim 1, wherein the computer-implemented communication system is integrated with the base station.

16. A method of using a security system, comprising:

receiving data by a checkpoint system from peripheral equipment comprising at least one of a plurality of sensors, video cameras, positioning systems and mobile communication and data processing equipment, processing the data, relaying information based on the data received from said peripheral equipment to a base station, providing a human guard with information based on the data;

filtering the information from the checkpoint system based on comparison to context data comprising recent historical data;

logging the information from the checkpoint system, processing the information from the checkpoint system, reporting the information from the checkpoint system at the base station to provide a security system status and facilitate human supervision, situation analysis, decision making, and intervention.

17. The method of claim 16, further comprising:

generating alerts associated with the information from the checkpoint system, if prompted by a base station software program; and transmitting the information from the base station to a headquarters station, where human supervision of environmental and event-related activities, human situation analysis, human intervention, and activation of security countermeasures are enabled, including preventions, deterrents, and mitigation of criminal acts, terrorist acts, war acts, riots, civil unrest, political events, structural failures, electronic failures, adverse weather, fire hazards, seismic events, variations in temperature and light conditions, and hazardous conditions requiring situation assessment and countermeasures.

18. The method of claim 17, further comprising exchanging the information within the security system using a communication system with XML language using a compressed XML format.

19. The method of claim 16, further comprising providing the data received from the peripheral equipment to a message concentrator.

20. The method of claim 19, further comprising directing the information to a message queue.

21. The method of claim 20, further comprising sorting of the information in the message queue into more than one specific queues corresponding a source of the information.

22. A security system for interactive training of a human guard, comprising:

a checkpoint system configured for receiving, processing, and relaying data received from peripheral equipment comprising at least one of a plurality of sensors, video cameras, positioning systems, and mobile communication and data processing equipment, and providing a human guard with information based on the data; and a base station configured for logging, processing, and reporting the data relayed from the checkpoint system to provide a security system status and to facilitate human supervision, situation analysis, decision making, and intervention, and wherein the security system provides the human guard with data for interactive training of the human guard, whereby the security system enhances the performance of the security system by improving the education and training of the human guard with respect to the security system.

23. The security system of claim 22, wherein the interactive training of the human guard comprises event drills.

24. The security system of claim 22, wherein the data for the interactive training of the human guard comprises operating instructions.

25. The security system of claim 22, wherein the interactive training of the human guard comprises interactive testing of skills of the human guard related to components of the security system, including software, hardware, and communication links.

26. A security system, comprising:

a checkpoint system configured for receiving, processing, and relaying data received from peripheral equipment comprising at least one of a plurality of sensors, video cameras, positioning systems, and mobile communication and data processing equipment, and providing a human with information based on the data; and a combined base station/headquarters station comprising a database memory unit and a back-up database memory unit, wherein said combined station receives the data from the checkpoint system, stores the data in a database, provides human access to the data, generates alerts if prompted by the station software program, and facilitates human supervision, situation analysis, decision making, and intervention.

* * * * *